US011692242B2

(12) United States Patent
Hussein et al.

(10) Patent No.: US 11,692,242 B2
(45) Date of Patent: Jul. 4, 2023

(54) METHOD OF PRODUCING BIODEGRADABLE MAGNESIUM COMPOSITE BY SPARK PLASMA SINTERING

(71) Applicant: King Fahd University of Petroleum and Minerals, Dhahran (SA)

(72) Inventors: Mohamed Abdrabou Hussein, Dhahran (SA); Murad Ali, Dhahran (SA); Nasser Al-Aqeeli, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 52 days.

(21) Appl. No.: 16/672,866

(22) Filed: Nov. 4, 2019

(65) Prior Publication Data

US 2021/0130930 A1 May 6, 2021

(51) Int. Cl.

| | |
|---|---|
| ***C22C 1/05*** | (2023.01) |
| ***C22C 1/04*** | (2023.01) |
| ***B22F 9/04*** | (2006.01) |
| ***B22F 3/105*** | (2006.01) |

(52) U.S. Cl.

CPC ..... *C22C 1/05* (2013.01); *B22F 9/04* (2013.01); *C22C 1/0408* (2013.01); *B22F 2003/1051* (2013.01); *B22F 2009/041* (2013.01); *B22F 2201/10* (2013.01); *B22F 2301/058* (2013.01)

(58) Field of Classification Search

CPC ..... C22C 1/05

See application file for complete search history.

(56) References Cited

U.S. PATENT DOCUMENTS

| | | | | |
|---|---|---|---|---|
| 9,993,996 | B2 | 6/2018 | Chung | |
| 2018/0133789 | A1* | 5/2018 | Yahata | B22F 1/17 |
| 2018/0214949 | A1* | 8/2018 | Martin | B22F 10/20 |

FOREIGN PATENT DOCUMENTS

| | | | |
|---|---|---|---|
| CN | 1441075 | A | 9/2003 |
| CN | 102978434 | A | 3/2013 |
| CN | 108588520 | A | 9/2018 |

(Continued)

OTHER PUBLICATIONS

Suryanarayana, Cury. "Mechanical alloying and milling." Progress in materials science 46.1-2 (2001): 1-184. (Year: 2001).*

(Continued)

*Primary Examiner* — Jophy S. Koshy
*Assistant Examiner* — Joshua S Carpenter
(74) *Attorney, Agent, or Firm* — Oblon, McClelland, Maier & Neustadt, L.L.P.

(57) ABSTRACT

A method for producing a biodegradable magnesium metal composite that includes a polycrystalline magnesium matrix and $TiB_2$ grains which are homogenously distributed in the polycrystalline magnesium matrix involving spark plasma sintering a milled mixture of magnesium powder and $TiB_2$ powder. The temperature, pressure, and time of the spark plasma sintering used in the method are used to give high microharness, macrohardness, and density with low porosity by limiting the grain growth in the composite. The method yields a biodegradable magnesium metal composite having an improved microhardness, macrohardness, density, and porosity compared to other composites and methods of making composites.

20 Claims, 16 Drawing Sheets

(56) References Cited

FOREIGN PATENT DOCUMENTS

| | | | | |
|---|---|---|---|---|
| DE | 102014002583 B3 * | 5/2015 | ..... | B22D 17/007 |
| JP | 2011-184276 A | 9/2011 | | |

OTHER PUBLICATIONS

Sankaranarayanan, S., S. Jayalakshmi, and M. Gupta. "Effect of individual and combined addition of micro/nano-sized metallic elements on the microstructure and mechanical properties of pure Mg." Materials & Design 37 (2012): 274-284 (Year: 2012).*

Espacenet machine translation of DE-102014002583-B3 retrieved on Mar. 19, 2022 (Year: 2015).*

Cheng, Yinlong, et al. "Effect of particle size on densification of pure magnesium during spark plasma sintering." Advanced Powder Technology 28.4 (2017): 1129-1135. (Year: 2017).*

Wang, et al. ; Fabrication of TiB particulate reinforced magnesium matrix composites by two-step processing method ; Materials Letters vol. 60, Issue 12 ; pp. 1533-1537 ; Jun. 2006 ; Abstract Only ; 2 Pages.

Wang, et al. ; Solidification behavior of cast TiB particulate reinforced Mg composites ; Materials Science and Engineering: A, vol. 478, Issues 1-2 ; pp. 9-15 ; Apr. 15, 2008 ; Abstract Only ; 2 Pages.

Shamekh ; Processing and Characterization of Mg Matrix Composites Reinforced with TiC and TiB2 Phases using an In-situ Reactive Infiltration Technique Concordia University thesis ; Jul. 2011 ; 277 Pages.

* cited by examiner

METHOD OF PRODUCING BIODEGRADABLE MAGNESIUM COMPOSITE BY SPARK PLASMA SINTERING

STATEMENT OF ACKNOWLEDGMENT

The inventors gratefully acknowledge the support of this work from the King Fahd University of Petroleum & Minerals (KFUPM).

BACKGROUND OF THE INVENTION

Field of the Invention

The present disclosure relates to a method of preparing a biodegradable magnesium metal composite and the composite produced by the method.

Discussion of the Background

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Magnesium-based materials have shown a great impact on various industrial sectors, including the automobile and aerospace industries due to the low density (1.738 g/cm$^3$), high strength/weight ratio and stiffness of Mg [Campo, R. del, et. al., 2014, J. Mech. Behav. Biomed. Mater., 39, 238-246; and Hassan, S. F., and Gupta, M., 2002, Mater. Res. Bull., 37(2), 377-389]. However, Mg has a comparatively low elastic modulus, low strength, insufficient ductility, high creep, high wear, low corrosion resistance, and fatigue that could limit its industrial use [DeGarmo, E., et. al., 1997, Materials and Process in Manufacturing]. Nevertheless, many efforts have been made by researchers to fabricate Mg-based alloys or composites with Cu, Ti, Al, $TiO_2$, ZnO, $Al_2O_3$, $ZrO_2$, and $TiB_2$ to achieve the desired mechanical properties and enhanced ductility [Garcés, G., et. al., 2007, Compos. Sci. Technol., 67(3-4), 632-637; Hassan, S. F., and Gupta, M., 2003, Mater. Sci. Technol., 19(2), 253-259; Hassan, S. F., and Gupta, M., 2002, J. Alloys Compd., 345(1), 246-251; Gu, X. N., et. al., 2011, J. Biomed. Mater. Res. Part B Appl. Biomater., 99B(1), 127-134; Rashad, M., et. al., 2015, J. Magnes. Alloy., 3(1), 1-9; Meenashisundaram, G. K., et. al., 2015, Mater. Des., 65, 104-114; Sankaranarayanan, S., et. al., 2014, J. Alloys Compd., 615, 211-219; Hassan, S. F., and Gupta, M., 2005, Mater. Sci. Eng. A, 392(1-2), 163-168; Hassan, S. F., and Gupta, M., 2007, J. Compos. Mater., 41(21), 2533-2543; and Meenashisundaram, G. K., et. al., 2014, Mater. Charact., 94, 178-188]. Magnesium is one of the most suitable biocompatible and biodegradable elements. Therefore, Mg-based materials have great potential for use in biomedical applications [Staiger, M. P., et. al., 2006, Biomaterials, 27(9), 1728-1734; and Tang, W. N., et. al., 2011, Mater. Des., 32(6), 3537-3543]. Cobalt-chromium alloys, austenitic stainless steel, and Ti-based materials are extensively used in medical applications. However, the use of these materials results in toxic products that are harmful to the patients and require costly post-surgery care after the healing process [Barrère, F., et. al., 2008, Mater. Sci. Eng. R Reports, 59(1-6), 38-71; Jaiswal, S., et. al., 2018, J. Mech. Behav. Biomed. Mater., 78, 442-454; Eddy Jai Poinern, G., et. al., 2013, Am. J. Biomed. Eng., 2(6), 218-240; Best, S. M., et. al., 2008, J. Eur. Ceram. Soc., 28(7), 1319-1327; Kannan, S., et. al., 2003, Mater. Lett., 57(16-17), 2382-2389; and Niinomi, M., 2002, Metall. Mater. Trans. A, 33(3), 477-486]. In addition, the mechanical properties of Mg, with an elastic modulus of 45 GPa, which is in the range of the elastic modulus of human bone (40-57 GPa), minimize the bone shielding effect [Li, L., et. al., 2004, Surf. Coatings Technol., 185(1), 92-98; and Ong, T. H. D., et. al., 2017, Mater. Sci. Eng. C, 78, 647-652]. One way to achieve a suitable Mg-based material with adequate mechanical properties for biomedical applications is to incorporate a suitable reinforcement in the Mg matrix. The improvement in the mechanical properties of the Mg matrix is highly dependent on the uniform distribution of the reinforcement [Umeda, J., et. al., 2010, Mater. Chem. Phys., 123(2), 649-657; and Nai, M. H., et. al., 2014, Mater. Des., 60, 490-495]. Different methods have been reported for fabricating Mg-based composites, such as stir casting [Ma, C., et. al., 2013, J. Biomed. Mater. Res. Part B Appl. Biomater., 101B(5), 870-877; Khoshzaban Khosroshahi, H., et. al., 2014, Mater. Sci. Eng. A, 595, 284-290; and Khanra, A. K., et. al., 2010, Mater. Sci. Eng. A, 527(23), 6283-6288], squeeze casting [Chen, B., et. al., 2016, J. Mater. Sci. Technol., 32(9), 858-864], mechanical alloying [E. Mohammadi Zahrani, and M. H. Fathi, 2009, Ceram. Int., 35(6), 2311-2323; Stüpp, C. A., et. al., 2015, Springer, Cham, 425-429; Fathi, M. H., and Zahrani, E. M., 2009, J. Alloys Compd., 475(1-2), 408-414; Hussein, M. A., et. al., 2015, Mater. Des., 83(Supplement C), 344-351.], liquid infiltration [Gu, X. N., et. al., 2011, J. Biomed. Mater. Res. Part B Appl. Biomater., 99B(1), 127-134] and a powder metallurgy process [E. Mohammadi Zahrani, and M. H. Fathi, 2009, Ceram. Int., 35(6), 2311-2323; Stüpp, C. A., et. al., 2015, Springer, Cham, 425-429; Zheng, Y. F., et. al., 2010, Acta Biomater., 6(5), 1783-1791; Henriques, V. A. R., et. al., 2010, J. Mater. Sci., 45(21), 5844-5850; Hassan, S. F., 2016, Arch. Metall. Mater., 61(3), 1521-1528; Kumar, P. S., et. al., 2017, Arch. Metall. Mater., 62(3), 1851-1856; Cay, H., et. al., 2013, Mater. Sci. Eng. A, 574; Rashad, M., et. al., 2013, J. Magnes. Alloy., 1(3), 242-248; and Hassan, S. F., and Gupta, M., 2006, Compos. Struct., 72(1), 19-26]. In powder metallurgy, the reinforcement could be well distributed within the matrix in the absence of an interaction or with the minimum interaction between the matrix and reinforcement.

Generally, to achieve a homogenous distribution of a reinforcement material within a matrix in powder metallurgy, powders of the matrix and reinforcement materials are ground or mixed together. After a powder is mixed, consolidation of the powder mixture may be carried out by sintering, the process of transforming a powdered material or one composed of individual particles into a single solid or porous solid material by heating below the melting point of the material. Recently, however, a new sintering technique called spark plasma sintering (SPS) has been developed for other ceramic and metal composites, but not biodegradable magnesium-based composites. In this technique, the powder material is heated by the application of electrical current and compacted simultaneously to achieve maximum density and minimum grain growth due to the high heating rate and a reduced experimental time compared to the conventional sintering techniques [Oghbaei, M., and Mirzaee, O., 2010, J. Alloys Compd., 494(1-2), 175-189; and Hussein, M. A., et. al., 2015, Mater. Des., 87(87), 693-700.]. SPS could provide a lower sintering temperature and a shorter sintering time, resulting in improved mechanical properties compared to the conventional sintering technique. Researchers have used SPS extensively in the fabrication of various metals, ceramics, and their alloys and composites [Salamon, D., and Shen, Z., 2008, Mater. Sci. Eng. A, 475(1-2), 105-107; Yaman, B., and Mandal, H., 2009, Mater. Lett., 63(12), 1041-1043; Gao, N., et. al., 2002, J. Eur. Ceram. Soc., 22(13), 2365-2370; Omori, M., 2000, Mater. Sci. Eng. A, 287(2), 183-188]. However, there is a scarcity of literature using SPS for Mg-based composites. Nguyen et al. successfully developed an Mg-based in situ composite of Mg—ZnO using SPS with improved corrosion resistance in Hank's solution [Cao, N. Q., et. al., 2017, Metals (Basel), 7(9), 358]. This kind of improvement is generally difficult using conventional sintering techniques [Omori, M., 2000, Mater. Sci. Eng. A, 287(2), 183-188; and Chartier, T., and Badev, A., 2013, Handbook of Advanced Ceramics: Chapter 6.5. Rapid Prototyping of Ceramics]. This improved corrosion resistance and the inclusion of zinc oxide particles in the composite developed by Nguyen, et. al., however, is disadvantageous for biodegradability or biocompatibility. Biodegradability is a critical factor in developing composites useful for biomedical applications.

Titanium diboride ($TiB_2$) is a ceramic reinforcement with a high melting temperature (2790° C.), high Rockwell hardness (86 HRA), high Vickers's hardness (960 Hv), a high elastic modulus of 530 GPa and excellent thermal stability [Tee, K., et. al., 1999, J. Mater. Process. Technol., 89-90, 513-519]. As a result of these excellent properties, $TiB_2$ has a wide range of applications in erosion, corrosion, abrasion and high-temperature applications [Wong, M., and Lee, Y. C., 1999, Surf. Coatings Technol., 120-121, 194-199]. Recently, a Mg matrix was reinforced with $TiB_2$ to enhance the mechanical properties and the resulting composite has become more attractive in orthopedic applications. Powder metallurgy using conventional sintering techniques have been used to fabricate Mg—$TiB_2$ composites, and significant improvements in hardness and wear resistance were achieved [Wang, H. Y., et. al., 2004, Mater. Lett., 58(27-28), 3509-3513]. Such composites, however, show the disadvantageous properties associated with conventional sintering techniques discussed above such as increased grain growth during longer sintering times to increase density and decrease porosity or low density and high porosity from insufficient compaction during shorter sintering times to limit grain growth. Similarly, Mg—$TiB_2$ nanocomposites have been prepared by disintegrated melt deposition followed by hot extrusion. These nanocomposites showed improved compressive yield strength, compressive tensile strength, fracture strain, and modified basal texture [Meenashisundaram, G. K., et. al., 2014, Mater. Charact., 94, 178-188]. Melt deposition and hot extrusion, however, do not have the advantages that sintering methods have of being able to fabricate shapes that are not achievable with extrusion methods, such as a tapered rod or a complicated shape with curves in multiple directions.

Properties such as microhardness, macrohardness, grain size, porosity, and density are poor for the aforementioned materials. In view of the forgoing, one object of the present disclosure is to provide a method for producing biodegradable composites of Mg with $TiB_2$ using spark plasma sintering such that the composite has hardness and density properties suitable for biomedical uses. Another object of the present disclosure is to provide biodegradable composites of Mg with $TiB_2$.

SUMMARY OF THE INVENTION

The present disclosure relates to a method of preparing a biodegradable magnesium metal composite involving milling a mixture of magnesium powder and $TiB_2$ powder to form a milled powder and spark plasma sintering the milled powder to form the biodegradable magnesium metal composite, wherein the biodegradable magnesium metal composite comprises a polycrystalline magnesium matrix and $TiB_2$ grains which are homogenously distributed in the polycrystalline magnesium matrix, and the $TiB_2$ grains have a mean grain size of 20 to 50 μm and the polycrystalline magnesium matrix is in the form of a polycrystalline matrix of magnesium grains having a mean grain size of 20 to 50 μm.

In preferred embodiments, the milling is performed in a vial at 50 to 500 rpm for 1 to 120 minutes without the use of balls and is performed in an inert atmosphere.

In preferred embodiments, $TiB_2$ is present in the biodegradable magnesium metal composite in an amount of 0.5 wt. % to 5.0 wt. % based on a total weight of the biodegradable magnesium metal composite.

In preferred embodiments, the biodegradable magnesium metal composite consists essentially of crystalline Mg and crystalline $TiB_2$ phases and has no other crystalline phases present detectable by X-Ray diffraction or electron microscopy.

In preferred embodiments, the polycrystalline magnesium matrix has a basal texture.

In preferred embodiments, the spark plasma sintering is performed at a pressure of 20-60 MPa.

In preferred embodiments, the spark plasma sintering is performed at a temperature of 400 to 600° C.

In preferred embodiments, the spark plasma sintering is performed for 1-20 minutes.

In preferred embodiments, a rate of heating during the spark plasma sintering is 40 to 200° C./min.

In preferred embodiments, the biodegradable magnesium metal composite has a microhardness of 40 to 65 Hv.

In preferred embodiments, the biodegradable magnesium metal composite has a macrohardness of 36 to 65 Hv.

In preferred embodiments, the biodegradable magnesium metal composite has a density of 1.720 to 1.810 g/cm$^3$.

In preferred embodiments, the biodegradable magnesium metal composite has a porosity of 0.1 to 5%.

The present disclosure also relates a biodegradable magnesium metal composite, comprising a polycrystalline matrix of magnesium metal grains and $TiB_2$ in an amount on the range of 0.5 wt. % to 5.0 wt. %, wherein the polycrystalline matrix of magnesium metal grains has a mean grain size of 20 to 50 μm, and the $TiB_2$ is in the form of crystalline grains having a mean grain size of 20 to 50 μm, which are homogeneously distributed in the matrix of magnesium metal grains.

In preferred embodiments, the polycrystalline matrix of magnesium metal grains has a basal texture.

In preferred embodiments, the biodegradable magnesium metal composite consists essentially of crystalline Mg and crystalline $TiB_2$ phases and has no other crystalline phases present detectable by X-Ray diffraction or electron microscopy.

In preferred embodiments, the biodegradable magnesium metal composite has a microhardness of 40 to 65 Hv.

In preferred embodiments, the biodegradable magnesium metal composite has a macrohardness of 36 to 65 Hv.

In preferred embodiments, the biodegradable magnesium metal composite has a density of 1.720 to 1.810 g/cm$^3$.

In preferred embodiments, the biodegradable magnesium metal composite has a porosity of 0.1 to 5%.

BRIEF DESCRIPTION OF THE DRAWINGS

FIG. 6B shows the Mg content, FIG. 6C shows the Ti content, FIG. 6D shows the B content, and FIG. 6E shows the O content;

DETAILED DESCRIPTION OF THE INVENTION

Figure 1:
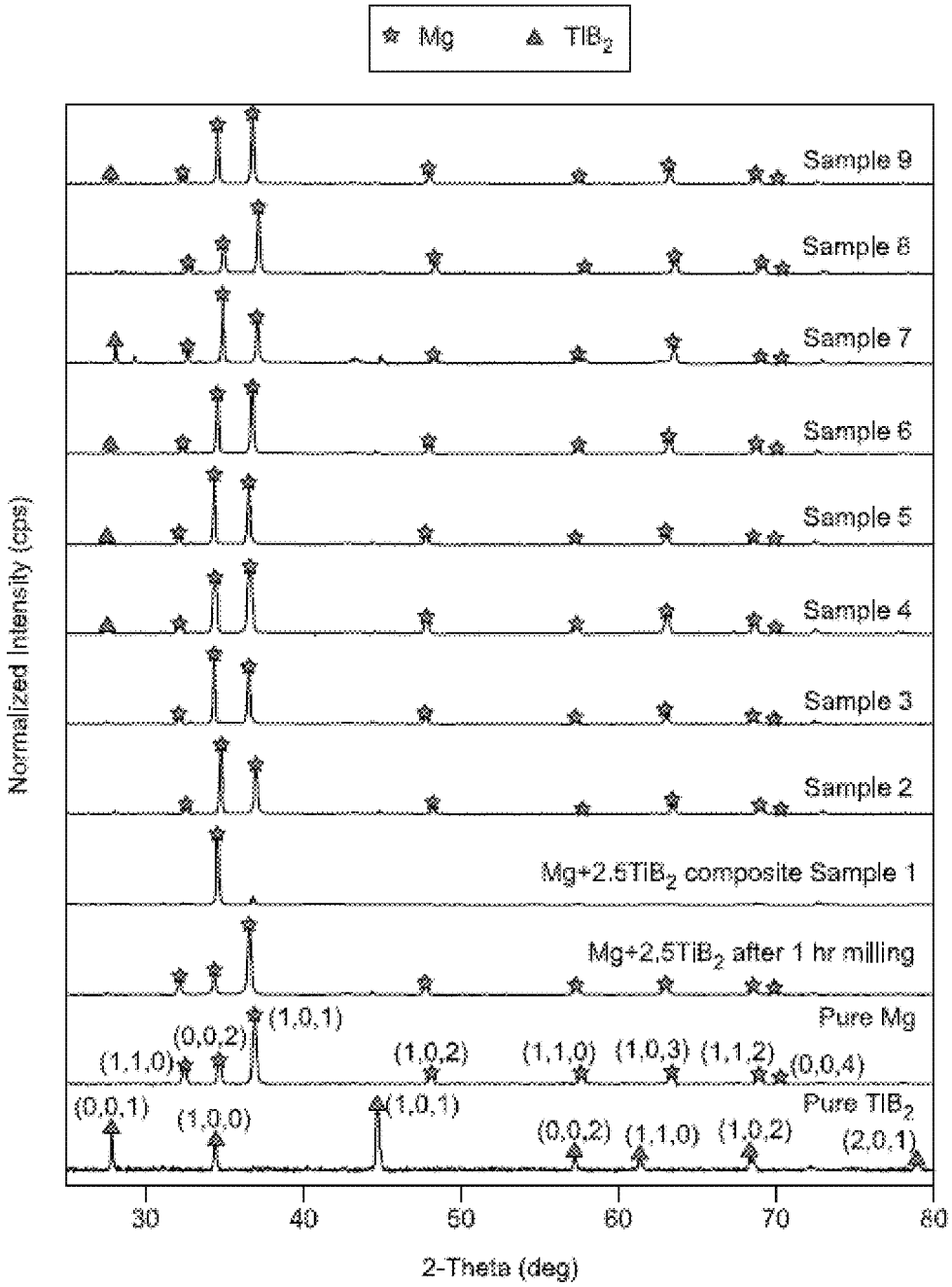
FIG. 1 shows X-ray patterns of $TiB_2$, pure Mg, and Mg-2.5TiB2 composite samples 1-9.

In the following description, it is understood that other embodiments may be utilized and structural and operational changes may be made without departure from the scope of the present embodiments disclosed herein.

Definitions

The phrase "substantially free", unless otherwise specified, describes a particular component being present in an amount of less than about 1 wt. %, preferably less than about 0.5 wt. %, more preferably less than about 0.1 wt. %, even more preferably less than about 0.05 wt. %, yet even more preferably 0 wt. %, relative to a total weight of the composition being discussed.

As used herein, the terms "optional" or "optionally" means that the subsequently described event(s) can or cannot occur or the subsequently described component(s) may or may not be present (e.g., 0 wt. %).

Method for Preparing Biodegradable Magnesium Metal Composite

According to a first aspect, the present disclosure relates to a method of making a biodegradable magnesium metal composite using spark plasma sintering. Spark plasma sintering (also known as field assisted sintering technique or pulsed electric current sintering) is a method of sintering involving passing pulsed or unpulsed DC or AC electric current directly through a compacted powder of conductive material to sinter said material. Similar to other sintering methods, spark plasma sintering involves transforming a powdered material or one composed of individual particles into a single solid or porous solid material by heating below the melting point of the material. Sintering excludes techniques which melt material to the point of liquefaction. This makes sintering distinct from processes that involve molten or liquefied materials such as smelting then casting, solidification of liquid-metal-based thixotropic fluids, laser in-situ strengthening, semi-solid slurry stirring, and reactive melt infiltration techniques, While these techniques allow for the facile production of products with complicated topologies such as curves in more than one direction, the presence of liquefied materials may give rise to disadvantageous structures or properties of the material such as non-homogenous distribution of constituents, phase separation, lack of control of grain size, or the formation of undesirable components such as oxidized materials. Similar to other sintering techniques, spark plasma sintering allows for advantageous structures or properties such as homogenous distribution of constituents. Unlike other sintering methods such as liquid phase sintering, hot pressed sintering, pressureless sintering, and reactive sintering, however, spark plasma sintering allows for the use of higher heating and cooling rates than may not be available by these other sintering methods. These higher heating and cooling rates may be advantageous in controlling the size of grains that make up the material. Spark plasma sintering may allow for high density and/or low porosity to be achieved while limiting grain growth. Further, micro- and nanostructures that may be present or produced before a material is sintered may be lost in other sintering methods due to the longer heating and cooling times used in these other sintering methods. Longer heating and cooling times may lead to longer overall sintering process times which may have disadvantageous effects on controlling features such as microstructure or grain size in a sintered material. The faster heating and cooling rates used in spark plasma sintering may allow for shorter heating and cooling times which may allow for preservation of features such as microstructure or grain size that other sintering methods may not permit. Accordingly, spark plasma sintering may allow for a material to be formed at a lower temperature or pressure compared to other sintering methods and may afford new materials with properties not achievable by other sintering methods. Such properties may include microhardness, macrohardness, grain size, density, and porosity. The properties of a material made by spark plasma sintering may be dependent upon features of the method of the spark plasma sintering. Such features may include the identity of the material, the particle size of the material to be sintered, the pressure used in the spark plasma sintering, the heating and cooling rate used in the spark plasma sintering, the temperature used in the spark plasma sintering, and the time of the spark plasma sintering.

The method of making the biodegradable magnesium metal composite of the present disclosure involves milling a mixture of magnesium powder and titanium diboride powder to form a milled powder. In some embodiments, a mixture of magnesium powder and titanium diboride powder may be milled by a technique such as milling, grinding, ball milling, chopping, pulverizing, crushing, pounding, mincing, shredding, smashing, fragmenting, or another technique that may be used to reduce a material to small particles. In some embodiments, the milling may take place using a mill, ball mill, rod mill, autogenous mill, semi-autogenous grinding mill, pebble mill, buhrstone mill, burr mill, tower mill, vertical shaft impactor mill, a low energy milling machine, grinder, pulverizer, mortar and pestle, blender, crusher, or other implement used to reduce a material to small particles. In preferred embodiments, the milling takes place in a low energy milling machine at 1 to 5000 rpm, preferably 10 to 1000 rpm, preferably 25 to 750 rpm, preferably 50 to 500 rpm, preferably 100 to 300 rpm, preferably 150 to 250 rpm, preferably 200 rpm. In some embodiments, the mixture of magnesium powder and titanium diboride powder may be milled for 1 to 120 minutes, preferably 5 to 115 minutes, preferably 15 to 105 minutes, preferably 30 to 90 minutes, preferably 45 to 75 minutes, preferably for 60 minutes. In preferred embodiments, the milling is performed without the addition of balls of the type typically used in a ball mill. In some embodiments, the milling is performed in an autogenous mill or semi-autogenous mill. In preferred embodiments, the milling is performed in an inert atmosphere (e.g., Argon). In some embodiments, the mixture of magnesium powder and titanium diboride powder may be milled to particles having a mean particle size of 1 to 50 μm, preferably 5 to 45 μm, preferably 10 to 40 μm, preferably 15 to 30 μm, preferably 17.5 to 25 μm, 20 to 22.5 μm.

In preferred embodiments, the spark plasma sintering is performed at a pressure of 20 to 60 MPa, preferably 22 to 58 MPa, preferably 24 to 56 MPa, preferably 25 to 55 MPa, preferably 26 to 54 MPa, preferably 28 to 52 MPa, preferably 30 to 50 MPa. In preferred embodiments, the spark plasma sintering is performed at a temperature of 400 to 600° C., preferably 410 to 590° C., preferably 425 to 575° C., preferably 450 to 550° C. In preferred embodiments, the spark plasma sintering is performed for 1 to 20 minutes, preferably 2 to 18 minutes, preferably 3 to 17 minutes, preferably 4 to 16 minutes, preferably 5 to 15 minutes. In preferred embodiments, the rate of heating during the spark plasma sintering is 40 to 200° C./min, preferably 45 to 150° C./min, preferably 50 to 100° C./min.

Biodegradable Magnesium Metal Composite

In preferred embodiments, titanium diboride is present in the biodegradable magnesium metal composite in an amount of 0.5 to 5.0 wt %, preferably 0.75 to 4.5 wt %, preferably 1 to 4 wt %, preferably 1.25 to 3.5 wt %, preferably 1.5 to 3.25 wt %, preferably 2 to 3 wt %, preferably 2.25 to 2.75 wt %, preferably 2.5 wt % based on a total weight of the biodegradable magnesium metal composite.

In preferred embodiments, the biodegradable magnesium metal composite consists essentially of the polycrystalline magnesium matrix and the titanium diboride grains, meaning that at least 90 wt %, preferably at least 95 wt %, preferably at least 97.5 wt %, preferably at least 99 wt %, preferably at least 99.5 wt %, preferably at least 99.9 wt % of the total weight of the biodegradable magnesium metal composite is the polycrystalline magnesium matrix and the titanium diboride grains. The inclusion of the titanium diboride in the polycrystalline magnesium matrix has the effect of raising the microhardness and macrohardness of the composite. Other materials may also have the effect of increasing the microhardness or macrohardness of a magnesium metal composite. Examples of such materials include aluminum present in an amount equal to or greater than 6 wt % based on the total weight of the magnesium metal composite, zinc present in an amount equal to or greater than 3 wt % based on the total weight of the magnesium metal composite, copper present in an amount equal to or greater than 3 wt % based on the total weight of the magnesium metal composite, zirconium present in an amount equal to or greater than 1 wt % based on the total weight of the magnesium metal composite, other titanium-containing materials such as titanium oxide and titanium carbide present in any amount, and other boron-containing materials such as boron carbide present in any amount. In preferred embodiments, such microharness-increasing and/or macrohardness-increasing materials are not present. Certain non-hardening materials may be added to the composite for other purposes so long as they do not have the effect of increasing the microhardness or macrohardness of the composite by greater than 10%, preferably greater than 7.5%, preferably greater than 5%, preferably greater than 2.5%, preferably greater than 1% of the microhardness or macrohardness of the composite in the absence of said non-hardening material. Examples of purposes other than hardening a composite include increasing the corrosion resistance of the composite, increasing the melting temperature of the composite, or improving the castability of the composite. Examples of non-hardening materials include bismuth, copper, cadmium, rare earth elements, iron, thorium, strontium, lithium, manganese, nickel, lead, silver, chromium, silicon, tin, and calcium.

In preferred embodiments, the biodegradable magnesium metal composite contains titanium diboride grains having a mean grain size of 20 to 50 μm, preferably 21 to 49 μm, preferably 22 to 48 μm, preferably 23 to 45 μm, preferably 25 to 43 μm. In preferred embodiments, the titanium diboride grains are monodisperse with a coefficient of variation, defined as the ratio of the standard deviation to the mean grain size, of less than 15%, preferably less than 10%, preferably less than 9%, preferably less than 8%, preferably less than 7%, preferably less than 6%, preferably less than 5%. In preferred embodiments, the polycrystalline magnesium matrix is in the form of a polycrystalline matrix of magnesium grains having a mean grain size of 20 to 50 μm, preferably 21 to 49 μm, preferably 22 to 48 μm, preferably 23 to 47 μm, preferably 24 to 46 μm, preferably 25 to 45 μm, preferably 26 to 44.5 μm, preferably 27 to 44 μm, preferably 28 to 43.5 μm, preferably 29 to 43 μm, preferably 30 to 42 μm. In preferred embodiments, the magnesium grains are monodisperse with a coefficient of variation, defined as the ratio of the standard deviation to the mean grain size, of less tha 15%, preferably less than 10%, preferably less than 9%, preferably less than 8%, preferably less than 7%, preferably less than 6%, preferably less than 5%.

In preferred embodiments, the biodegradable has a basal texture. As used herein, the texture refers to a crystallographic texture. A crystallographic texture is the distribution of crystallographic orientations in a polycrystalline sample. In preferred embodiments, the biodegradable magnesium metal composite has a basal texture in which less than 25%, preferably less than 20%, preferably less than 15%, preferably less than 10%, preferably less than 5% of the magnesium grains have an orientation that deviates from basal by no more than 15°, preferably no more than 12.5°, preferably no more than 10°, preferably no more than 7.5°, preferably no more than 5°.

In preferred embodiments, the biodegradable magnesium metal composite has a microhardness of 40 to 65 Hv, preferably 41 to 64 Hv, preferably 42 to 63 Hv, preferably 43 to 62 Hv, preferably 44 to 61 Hv, preferably 45 to 60 Hv, preferably 47 to 59 Hv. In preferred embodiments, the biodegradable magnesium metal composite has a macrohardness of 36 to 65 Hv, preferably 38 to 64 Hv, preferably 49 to 63 Hv, preferably 50 to 62.75 Hv, preferably 57 to 62.5 Hv. In preferred embodiments, the biodegradable magnesium metal composite has a density of 1.720 to 1.810 g/cm$^3$, preferably 1.78 to 1.8076 g/cm$^3$, preferably 1.79 to 1.80297 g/cm$^3$. In preferred embodiments, the biodegradable magnesium metal composite has a porosity of 0.1 to 5%, preferably 0.2 to 4.5%, preferably 0.25 to 4%. In some embodiments, the porosity may be determined based on a comparison of the experimentally-determined density to a theoretical density of a perfectly non-porous sample of the same composition. In some embodiments, the porosity is the percent error of the density, calculated by taking the difference between the theoretical density and the experimentally-determined density and dividing the difference by the theoretical density. In alternative embodiments, the porosity may be determined by a suitable different technique known by one of ordinary skill in the art. In some embodiments, the pores have a mean pore size of 0.01 to 200%, preferably 0.1 to 100%, preferably 0.5 to 95%, preferably 1 to 90%, preferably 2.5 to 75%, preferably 10 to 50% of the mean grain size of the $TiB_2$ grains.

In preferred embodiments, the biodegradable magnesium metal composite has no other phases present detectable by X-ray diffraction or electron microscopy besides the polycrystalline magnesium matrix and the titanium diboride grains. In some embodiments, the titanium diboride grains of the biodegradable magnesium metal composite are detectable in an X-ray diffraction pattern of the composite. Such detection typically happens when the titanium diboride is present in an amount of at least 3 wt % based on the total weight of the composite. In such cases, the titanium diboride is detectably by electron microscopy techniques such as electron microscopy imaging, microanalysis, energy dispersive X-ray spectroscopy, or elemental mapping. In preferred embodiments, any other materials present do not form a separate phase detectable by any of the aforementioned techniques. Examples of such phases include the $\beta$-$Mg_{17}Al_{12}$ phase present in some aluminum-containing magnesium alloys such as AZ91 or AM50, the $Mg_2Ca$ phase present in some calcium-containing magnesium alloys such as AX51 or AX53, the $Mg_2Sn$ phase present in some tin-containing magnesium alloys such as AT55 or AT75, and the MgCuZn phase present in some zinc and copper-containing magnesium alloys such as ZC63.

In preferred embodiments, the biodegradable magnesium metal composite is biodegradable. As used herein, biodegradable refers to the ability of the composite to be dissolved, absorbed, consumed, or excreted from the body of a human or animal. Such biodegradability may be advantageous in applications such as medical devices.

One possible application for the biodegradable magnesium metal composite described above is for medical devices, particularly implantable medical devices. Such implantable medical devices may not require surgical removal due to the biodegradation of the device. Examples of implantable medical devices that may be made from the biodegradable magnesium metal composite include temporary orthopedic implants for bone repair or healing and cardiovascular stents for temporary treatment of narrow or blocked blood vessels. The microhardness, macrohardness, density, and porosity of the biodegradable magnesium metal composite may be advantageous for use in these applications, particularly in orthopedic applications where the mechanical properties of pure magnesium do not show values of these properties suitable for use.

The examples below are intended to further illustrate protocols for preparing and characterizing the biodegradable magnesium metal composite discussed above and for assessing microhardness and macrohardness properties of said biodegradable magnesium metal composite and are not intended to limit the scope of the claims.

Where a numerical limit or range is stated herein, the endpoints are included. Also, all values and subranges within a numerical limit or range are specifically included as if explicitly written out.

As used herein the words "a" and "an" and the like carry the meaning of "one or more."

All patents and other references mentioned above are incorporated in full herein by this reference, the same as if set forth at length.

EXAMPLES

The design of experiment (DOE), which includes the Taguchi method, response surface method, and factorial design, is now widely used to overcome the limitations of conventional techniques [Zuo, G., et. al., 2014, Desalination, 339, 1-9]. Based on the fractional factorial design, the Taguchi method is widely used to identify process parameters and reduce experimental time and cost [Khalifa, A. E., and Lawal, D. U., 2015, Arab. J. Sci. Eng., 40(12), 3627-3639; and Davim, J., and Aveiro, P., 2016, Design of Experiments in Production Engineering—incorporated herein by reference], and it is used to avoid the full factorial design by carefully choosing the experimental runs [Sahoo, P., et. al., 2017, Int. J. Ind. Eng. Comput., 385-398—incorporated herein by reference]. The two important tools of the Taguchi method are an orthogonal array (OA) and the signal-to-noise ratio (S/N), where OA represents a matrix consisting of rows and columns filled by all the possible combinations of the controllable variable [Mavruz, S., and Oğulata, R., 2010, Fibres and Textiles in Eastern Europe, 18(2), 78-83—incorporated herein by reference]. S/N is the ratio of sensitivity to variability; therefore, minimizing the noise effect results in maximizing the S/N ratio, which enhances the product quality attributes. In the Taguchi method, the S/N ratio is used as an indicator of quality characteristics. Here, the noise and, therefore, each experimental run under the same operating conditions to be an average of three values. In view of the objective function, the S/N ratio can be grouped as larger is the best, nominal is the best, and smaller is the best. For continuous characteristics, the S/N ratio characteristics can be mathematically defined by the following (1-3) equations.

For larger is the best, $$\frac{S}{N} = 10\log\frac{1}{n}\left(\sum\frac{1}{z^2}\right) \quad (1)$$

For nominal is the best, $$\frac{S}{N} = -10\log\frac{1}{n}\left(\sum \frac{z}{s^2 z}\right) \quad (2)$$

For smaller is the best, $$\frac{S}{N} = -10\log\frac{1}{n}\left(\sum z^2\right) \quad (3)$$

The values of z in the case of equations (1) and (3) are infinite and zero, respectively. However, a certain value of z is assigned in the case of equation (2). In these equations, n represents a number of experimental runs, and y represents the performance value (microhardness, macrohardness and experimental density). If the aim of the process is to achieve a maximum value, then the parameter levels giving the maximum value of S/N are best. However, if the aim of the process is to achieve a minimum value, then the parameter level giving a maximum value of S/N is best [Küçük, Ö., et. al., 2017, Metals (Basel), 7(9), 352—incorporated herein by reference]. Presently, the case is "larger is the best".

The experiments were performed according to a standard orthogonal array (SOA). The orthogonal array is selected only when the degree of freedom is equal to or greater than the sum of sintering parameters [Ma, C., et. al., 2013, J. Biomed. Mater. Res. Part B Appl. Biomater., 101B(5), 870-877; Khoshzaban Khosroshahi, H., et. al., 2014, Mater. Sci. Eng. A, 595, 284-290; Khanra, A. K., et. al., 2010, Mater. Sci. Eng. A, 527(23), 6283-6288; and Chen, B., et. al., 2016, J. Mater. Sci. Technol., 32(9), 858-864—incorporated herein by reference]. Table 1 depicts the factors and their levels for experiments consisting of 9 tests (each row in L9 OA) where the columns are assigned to parameters. In an SOA, the level of parameters is specified in each row of the OA. Here, an L9 orthogonal array with 9 rows and 3 columns was selected, as depicted in Table 2. The sintering parameters selected for the experiments were (i) S. Temp, (ii) S. Pres and (iii) S. Time. The responses to be analyzed were microhardness, macrohardness, and experimental density with the objective of larger is the best, and the responses were subjected to analysis of variance (ANOVA).

TABLE 1

Sintering parameters and their levels

| Level | S. Temp (° C.) | S. Pres (MPa) | S. Time (min) |
|---|---|---|---|
| 1 | 450 | 30 | 5 |
| 2 | 500 | 40 | 10 |
| 3 | 550 | 50 | 15 |

TABLE 2

Taguchi L9 design orthogonal arrays

| L9 Test Samples | S. Temp (° C.) | S. Pres (MPa) | S. Time (min) |
|---|---|---|---|
| 1 | 450 | 30 | 5 |
| 2 | 450 | 40 | 10 |
| 3 | 450 | 50 | 15 |
| 4 | 500 | 30 | 10 |
| 5 | 500 | 40 | 15 |
| 6 | 500 | 50 | 5 |
| 7 | 550 | 30 | 15 |
| 8 | 550 | 40 | 5 |
| 9 | 550 | 50 | 10 |

Materials and Processing

Mg powder with a purity >99.8% and an average particle size of <45 μm supplied by Alfa Aesar, USA, was used as the base material. Titanium diboride ($TiB_2$) powder with a purity of 99% and an average particle size of 10 μm, as supplied by BOC Science, USA, was used as the reinforcement. A pure Mg matrix with a 2.5 wt. % $TiB_2$ reinforcement was synthesized by a powder metallurgy processing route. A mixture of Mg and $TiB_2$ powders at the chosen ratio was combined using a low energy milling machine (Fritsch Pulverisette 5) and used for the homogeneous distribution of the reinforcement in the matrix material. The powder mixture was milled at 200 rpm for 1 h in stainless steel vials without balls filled with Ar gas. The milled powders were consolidated using SPS (FCT group, System GmBH, Germany) at three levels of sintering pressure, temperature and time according to the L9 orthogonal array. The milled powder mixture was loaded into a graphite die with a 14.8 mm diameter with respective punches. A thin graphite sheet was inserted between the powder mixture and the die wall to allow easy removal of the sample after consolidation. Additionally, this thin sheet could reduce friction between the die wall and powders. The powder mixture was consolidated in SPS using three different pressures of 30, 40 and 50 MPa. In the same way, three different sintering temperatures and sintering times were chosen: 450, 500, 550° C. and 5, 10 and 15 min, respectively. The heating rate of the powders was determined to be 50° C./min to achieve enhanced diffusion. The sintering temperature during consolidation was measured by inserting a thermocouple in the middle of the die placed 2 mm away from the die internal wall. The sintered samples were then cleaned from the graphite using grinding and polishing. The grinding was performed with SiC paper of 180, 320, 400, 600 and 800 grit sizes. This process was followed by polishing with a napped cloth and alumina slurry. To remove the small particles of alumina from the composites attached during polishing, the samples were immersed in ethanol solution and ultrasonicated for 15 min by a digital ultrasonic cleaner.

Characterization

The structures of the as-received powder, the milled Mg-2.5$TiB_2$ powder mixture and the sintered samples were characterized via X-ray diffraction (XRD) using Cu Kα radiation of wavelength λ=1.54056 Å and a scan speed of 20/min in an AXSDB Bruker machine.

The density of the spark plasma sintered Mg-2.5$TiB_2$ composite samples was measured using Archimedes' principle. The samples were weighed in air and then in distilled water using a digital scale with a ±0.00001 g accuracy. Then, an average of five values for density was reported in this paper. The rule-of-mixture method was used to calculate the theoretical density of the prepared composites. The distribution of the $TiB_2$ reinforcement and the surface morphology of the Mg-2.5$TiB_2$ composites were investigated. The microstructural study of spark plasma sintered samples was carried out using FE-SEM equipped with a Schottky field emission gun (TESCAN) and SEM equipped with a field emission gun (QUANTAM FEG 250).

Using a universal hardness machine (BUEHLER, 60044-USA), a Vickers hardness (Hv) test was carried out. The testing machine was equipped with a Vickers-diamond pyramid indenter with a 1360 phase angle to measure the microhardness. The flatly polished specimens were loaded with 200 gf and a dwell time of 10 s. An average of five Hv test values is reported here. The specimens were tested according to ISO 6507/ASTM E 384 standards.

Using a universal hardness testing machine (INNOVA, 783D) on metallographically polished samples, a Rockwell hardness (HR) test was conducted. The macrohardness of the specimen was calculated on an HR15T scale from a test machine equipped with a 1/16" diameter HM-ball indenter. The dwell time used in the experiment was 10 s. The tests were conducted according to the ISO 6508/ASTM E 18 standards. A mean of five test values of HR is reported here.

Results and Discussion

X-ray Diffraction Analysis

The X-ray diffraction characterization technique was used to investigate the effect of $TiB_2$ on the crystallography of the pure Mg matrix. The formation of the Mg-2.5$TiB_2$ composite was due to the fine wettability between the Mg matrix and the $TiB_2$ reinforcement [Xiuqing, Z., et. al., 2005, Mater. Lett., 59(17), 2105-2109—incorporated herein by reference]. The Mg basal texture can be altered by the interaction of the $TiB_2$ reinforcement with its crystallographic structure [Stanford, N., et. al., 2008, Scr. Mater., 59(7), 772-775—incorporated herein by reference]. The normalized XRD patterns of pure Mg, pure $TiB_2$, the milled Mg-2.5$TiB_2$ composite, and the spark plasma sintered composite samples are depicted in FIG. 1. In FIG. 1, highly prominent individual peaks of Mg and $TiB_2$ powder can be seen clearly. However, in the case of the Mg-2.5$TiB_2$ composite, only the prominent peaks of Mg can be seen easily. This result is because $TiB_2$ is present in a relatively low weight percent (<3 wt. %), meaning that the corresponding peaks are not clearly visible. Moreover, the presence of $TiB_2$ in the synthesized composite can be confirmed by the spark plasma sintered sample at elevated temperatures. The first peak of $TiB_2$ at $2\theta=27.94°$ can be observed in samples sintered at 500° C. and 550° C. The other peaks might be seen with relatively low intensities. It can be concluded from these spark plasma sintered samples that there are no extra peaks in the XRD spectrum, which confirms the nonexistence of any extra phase formed during the sintering process. This result also establishes that the SPS process can be successfully used to produce Mg-2.5$TiB_2$ composites. The three dominant peaks of the pure Mg hexagonal structure are (1010), (0002) and (1011) corresponding to prismatic, basal and pyramidic planes, respectively. These peaks were observed at diffraction angles of 32°, 34° and 36°, respectively. The intensity of the basal plane (0002) increased with the addition of 2.5 wt. % $TiB_2$ in the sintered samples. The dominance of basal planes in sintered samples compared to pure Mg is an indication of a strong basal texture. With the addition of $TiB_2$ in the Mg matrix, the intensity of the pyramidal plane (1011) decreased at lower sintering temperatures and increased at elevated temperatures. This variation in intensities can be observed easily in FIG. 1.

SEM Characterization

Figure 2A:
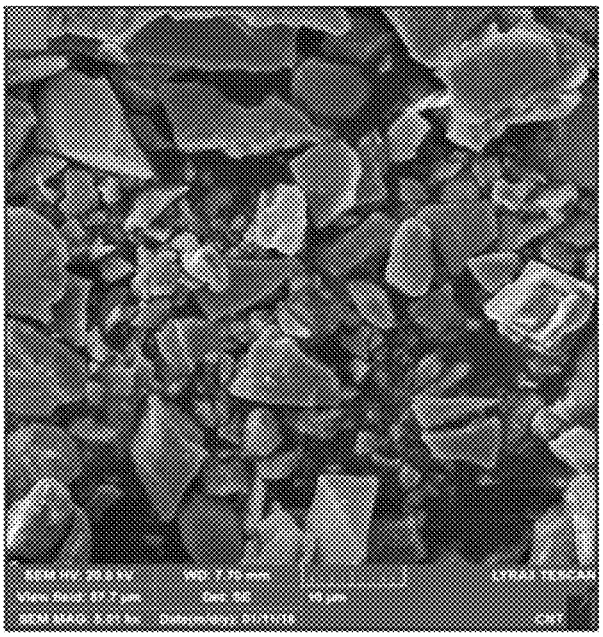
FIG. 2A is a scanning electron microscopy (SEM) image of pure Mg particles.
Figure 2B:
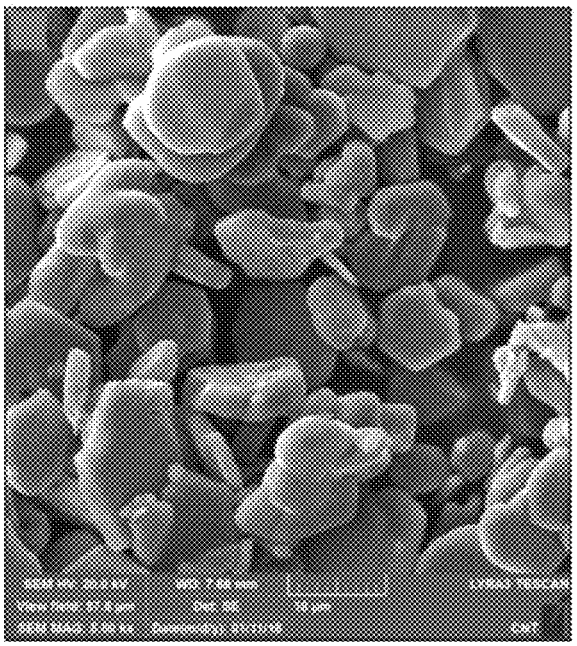
FIG. 2B is an SEM image of pure $TiB_2$ particles.
Figure 2C:
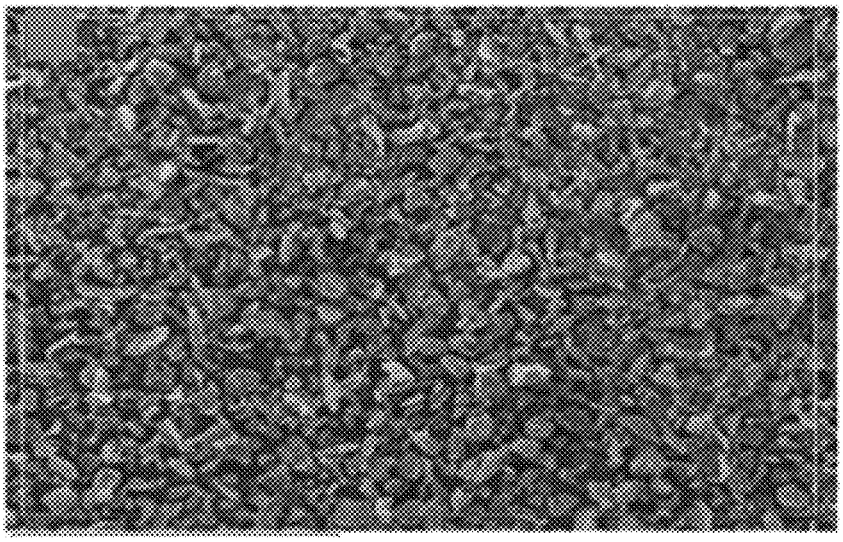
FIG. 2C is an SEM image of milled Mg-2.5$TiB_2$ powder before spark plasma sintering.
Figure 3A:
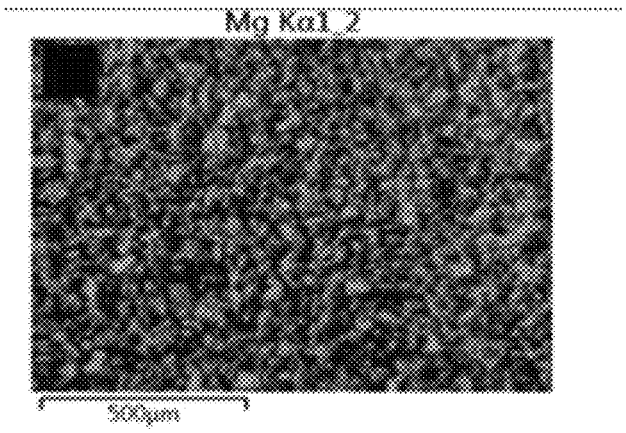
FIG. 3A is an energy-dispersive X-ray spectroscopy (EDX) map of the Mg in the sample of milled Mg-2.5$TiB_2$ powder depicted in FIG. 2C.
Figure 3B:
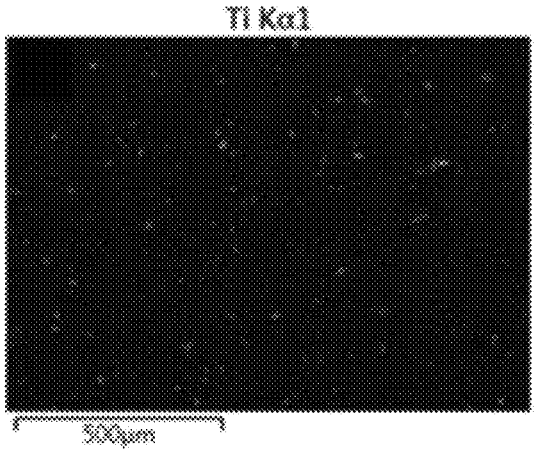
FIG. 3B is an EDX map of the Ti in the sample of milled Mg-2.5$TiB_2$ powder depicted in FIG. 2C.
Figure 3C:
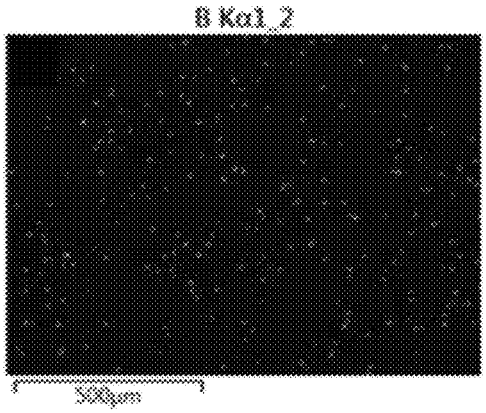
FIG. 3C is an EDX map of the B in the sample of milled Mg-2.5$TiB_2$ powder depicted in FIG. 2C.

The SEM micrographs provide qualitative analysis of the particle morphologies and shapes of the as-received Mg, $TiB_2$ and milled powder mixtures, which are presented in FIGS. 2A, 2B, and 2C, respectively. Both the as-received powders have irregular shapes with a wide range of size distributions. A particle size analyzer revealed that 50 vol % of pure Mg and $TiB_2$ have particle sizes less than 28.73 μm and 17.37 μm, respectively. However, after the milling process, the reduced particle size of the 50 vol % of Mg-2.5$TiB_2$ was observed to be 21.93 μm. In FIG. 2A, the secondary electron image shows that the Mg matrix consists of a wide range of particle size distributions, while FIG. 2B represents a more uniform particle size of the $TiB_2$ reinforcement. In addition, no visible large particles due to agglomeration could be seen, and this effect was even less noticeable under cold working. Furthermore, EDX mapping was carried out to observe the distribution of the reinforcement in the matrix using elemental analysis after the milling process. FIG. 3A-C, X-ray mapping shows a good distribution of Ti and B in the Mg matrix. The distribution is fairly good and confirms the effectiveness of the 1 h milling process.

Figure 4A:
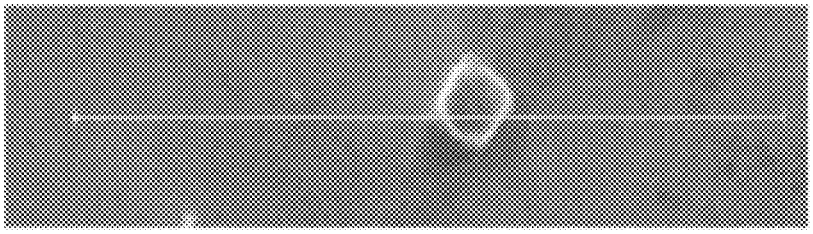
FIG. 4A is an SEM image depicting a grain of TiB2 in a sample of Mg-2.5$TiB_2$ composite and the path of EDX linescan.
Figure 4B:
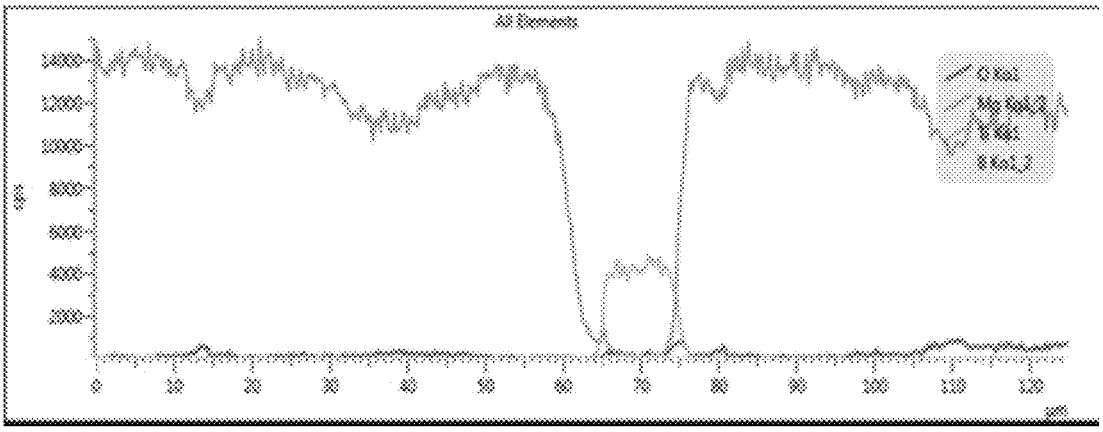
FIG. 4B is graph of the signal intensity for the EDX linescan depicted in FIG. 4A showing the intensities of O, Mg, Ti, and B.
Figure 5:
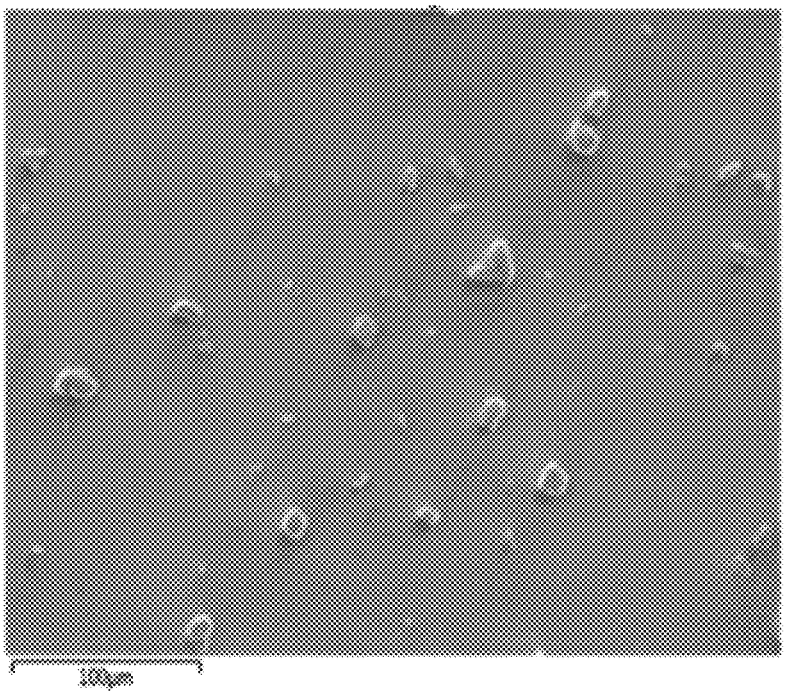
FIG. 5 is an SEM image of a sample of Mg-2.5$TiB_2$.
Figure 6A:
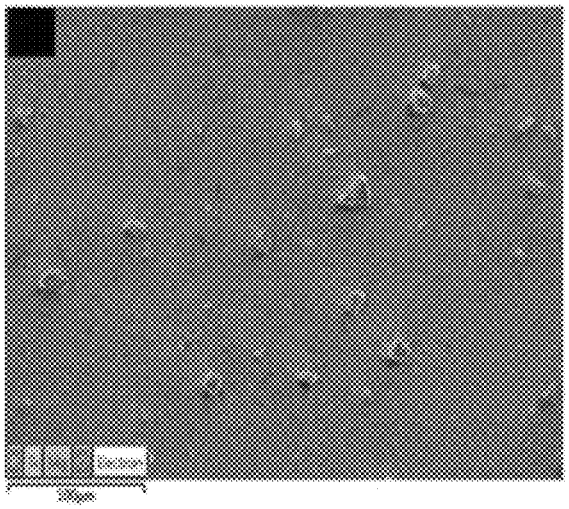
FIG. 6A is a composite EDX map of a the sample of Mg-2.5$TiB_2$ depicted in FIG. 5.
Figure 6B:
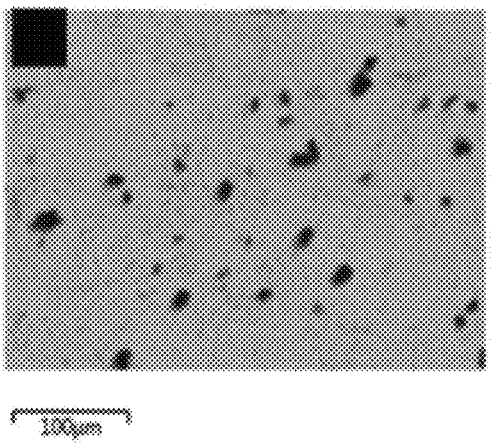
FIG. 6B-6E are single-element EDX maps of the sample of Mg-2.5$TiB_2$ depicted in FIG. 5 and compiled to form FIG. 6A, where
Figure 6C:
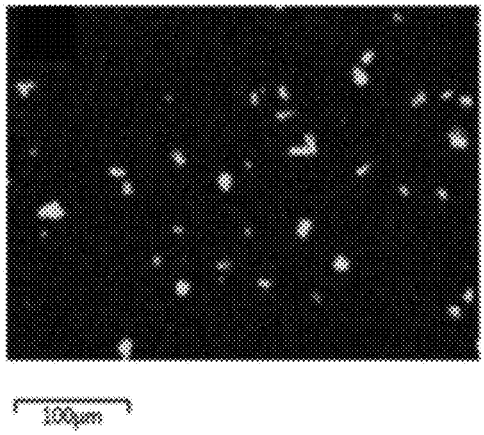
Figure 6D:
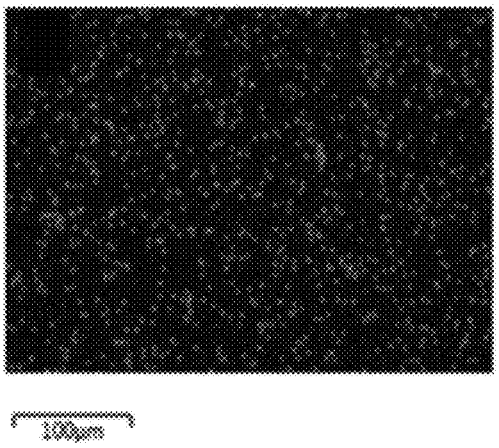
Figure 6E:
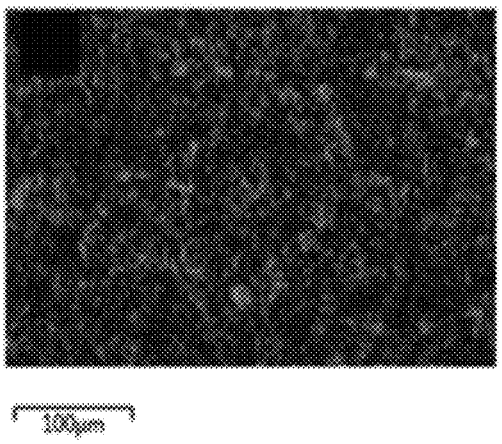
Figure 7A:
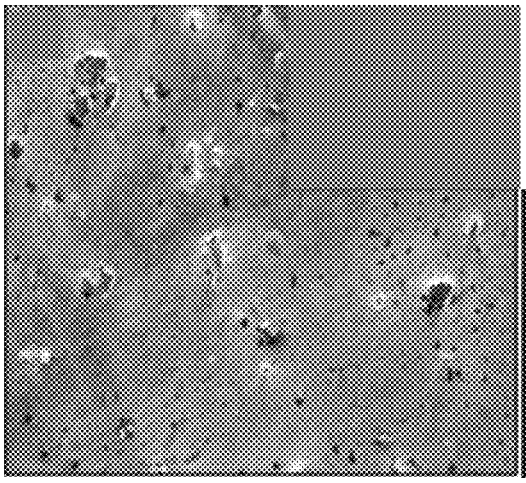
FIG. 7A-7R are SEM images of different samples of the Mg-2.5$TiB_2$ composite, where 7A, 7C, 7E, 7G, 7I, 7K, 7M, 7O, and 7Q are secondary electron-type images, and 7B, 7D, 7F, 7H, 7J, 7L, 7N, 7P, and 7R are backscattered images.
Figure 7B:
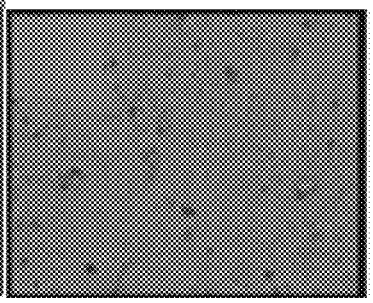
Figure 7C:
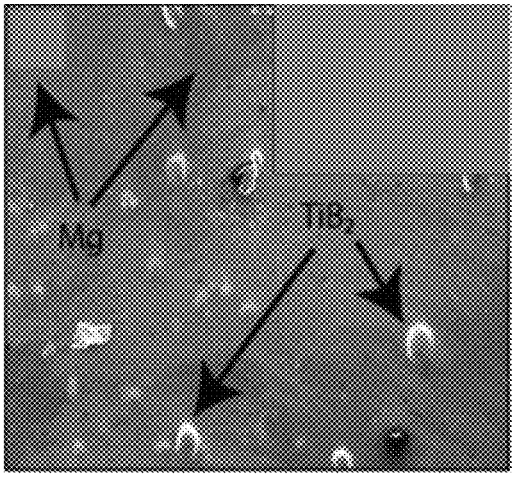
Figure 7D:
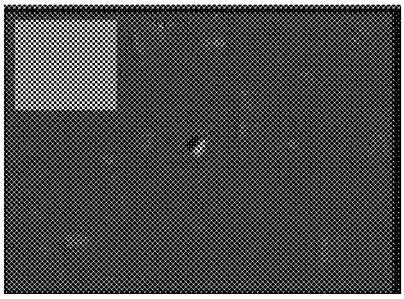
Figure 7E:
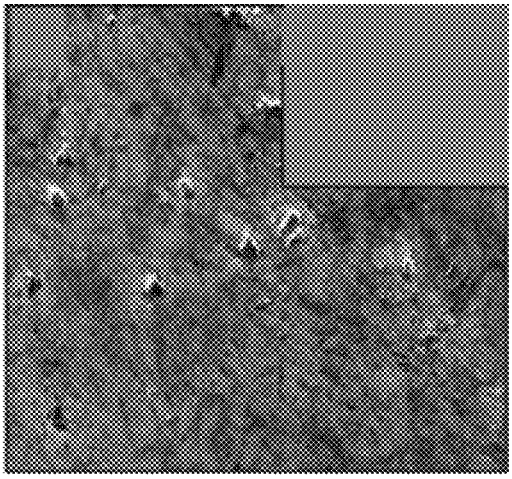
Figure 7F:
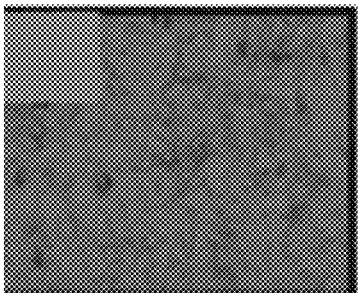
Figure 7G:
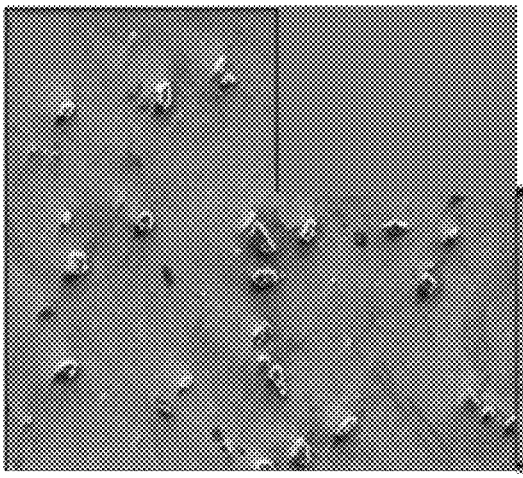
Figure 7H:
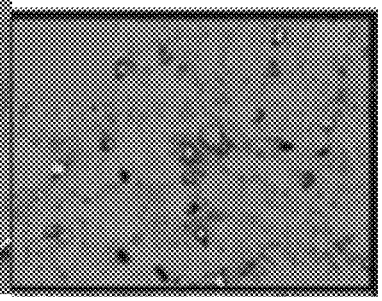
Figure 7I:
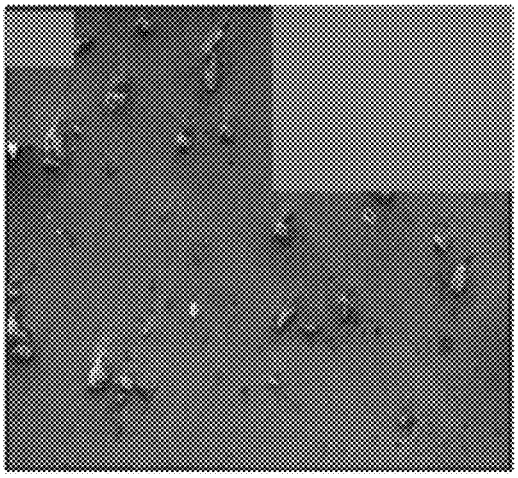
Figure 7J:
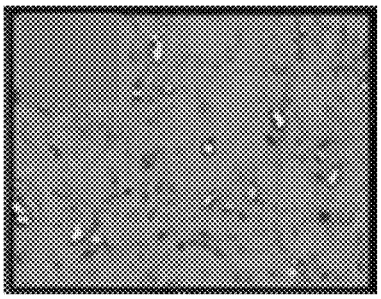
Figure 7K:
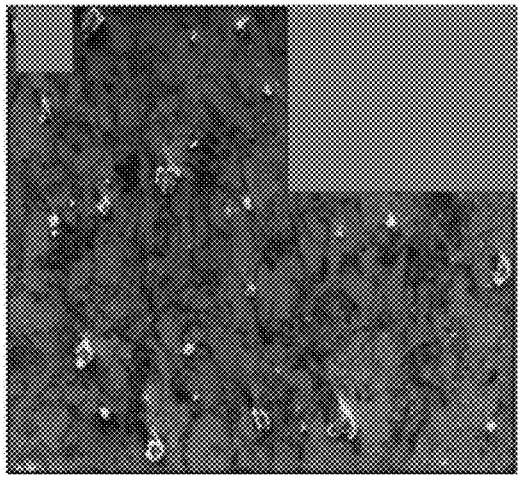
Figure 7L:
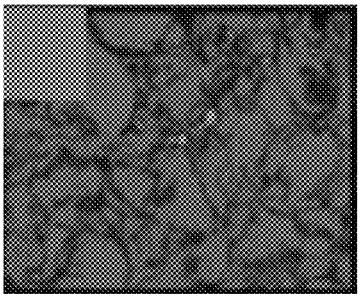
Figure 7M:
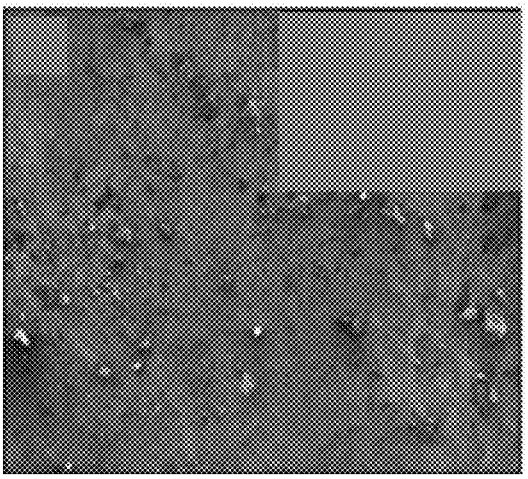
Figure 7N:
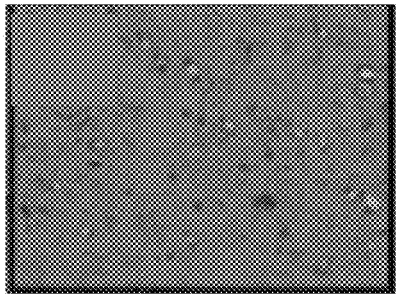
Figure 7O:
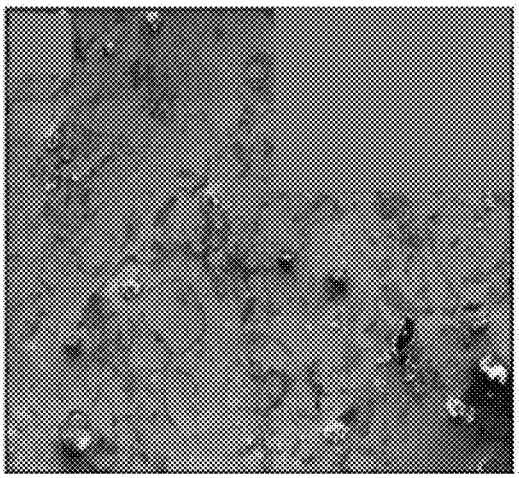
Figure 7P:
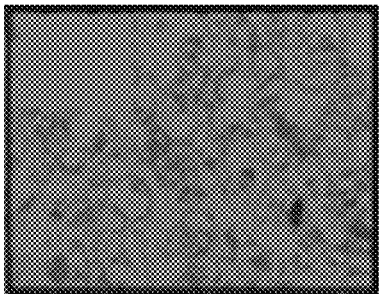
Figure 7Q:
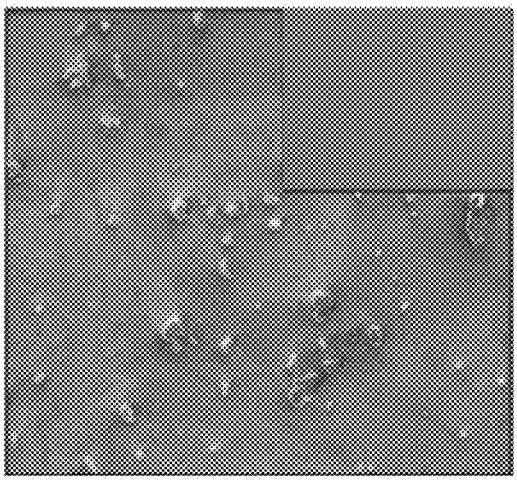
Figure 7R:
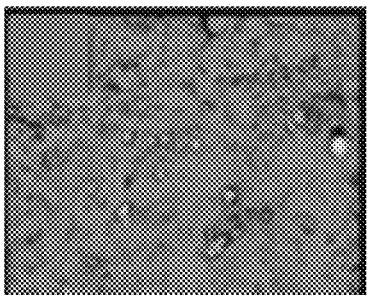

The FE-SEM micrographs of the spark plasma sintered samples revealed a reasonable distribution of the reinforcement in the matrix. The average size of the reinforcement in the matrix was approximately 25-30 μm, revealing some agglomeration. FE-SEM images of the sintered samples through SPS revealed no visible porosity. This result confirms the integrity of the spark plasma sintering process producing dense samples. FE-SEM micrographs also showed a reasonable distribution of $TiB_2$ in the Mg matrix with improved interfacial integrity. The improved interfacial integrity between the matrix and the reinforcement resulted in an absence of debonding and voids in all the sintered samples. The absence of micropores or shrinkage in the Mg-2.5$TiB_2$ composites could be noted from the micrographs. The EDX analysis of sintered samples revealed that the dark area consists of the Mg phase, while the semi-gray phase belongs to $TiB_2$. FIG. 4A-B, the low magnification SEM micrograph and EDX line scan of Mg, Ti, B, and O of the Mg-2.5$TiB_2$ composite are presented for sample 4. The line scan of Mg-2.5$TiB_2$ indicates that at the interface between the matrix and reinforcement, the Mg contents decreased gradually, while the Ti contents increased slowly, and boron was also detected during the analysis [Davis, T. A., and Bichler, L., 2018, J. Mater. Eng. Perform., 1-9.]. It was also observed that oxygen entrapment occurred on the surface of $TiB_2$ particles. This may lead to the formation of MgO at the interface between Mg and $TiB_2$. Nevertheless, the existence of MgO could not be confirmed using XRD analysis. The formation of the MgO layer could be attributed to the high oxidation of Mg during the milling process or the interaction with air/water during grinding and polishing. FIG. 5, $TiB_2$ particles in the Mg matrix could be observed with some agglomeration. However, the distribution could be considered reasonably uniform throughout the Mg matrix. FIG. 5 represents the SEM micrograph of sample 4. FIG. 6A represents the colored layer image of the same sample, indicating all the elements present. The presence of the Mg matrix, Ti, B, and O are evident from FIG. 6B-E. In FIGS. 7A-R, FE-SEM micrographs of all Mg-2.5$TiB_2$ samples are depicted. A reasonable $TiB_2$ reinforcement distribution could be seen clearly. The reinforcement exhibited a stable position within the matrix, and no overall pullout mechanism was observed, thus confirming a strong adhesion. This strong adhesion of the reinforcement provided adequate resistance to the indentation of Mg-2.5$TiB_2$ composites compared to the pure Mg matrix. In FIG. 7I, the reinforcement shows poor adhesion, possibly due to excessive grinding and polishing, which could be observed only in micrographs.

Influence of the Input Parameters on the Microhardness

The aim of this experiment was to identify the most influencing factors and their combinations affecting the microhardness of Mg-2.5$TiB_2$ composites. The input parameters and their three levels are depicted in Table 1 above. The L9 OA of the Taguchi design and measured microhardness are presented in Table 3 below.

Figure 8A:
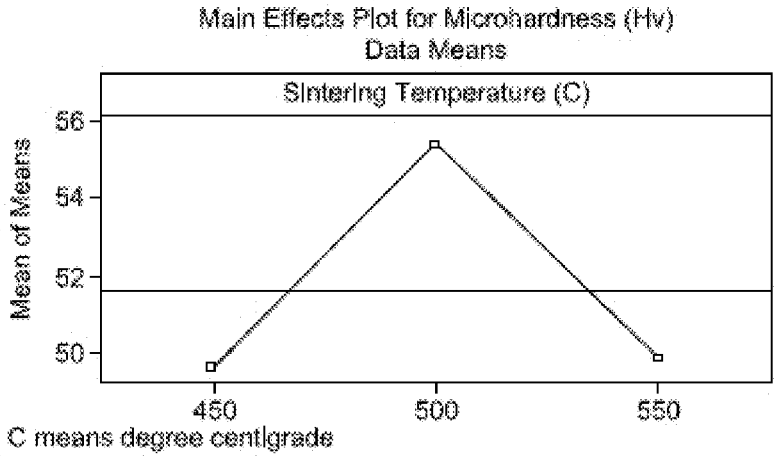
FIGS. 8A-8C show the main effect plots for microhardness, where FIG. 8A plots vs. sintering temperature, FIG. 8B plots vs. sintering pressure, and FIG. 8C plots vs sintering time.
Figure 8B:
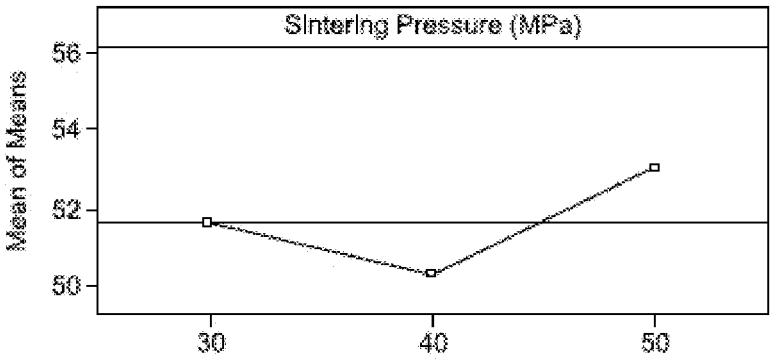
Figure 8C:
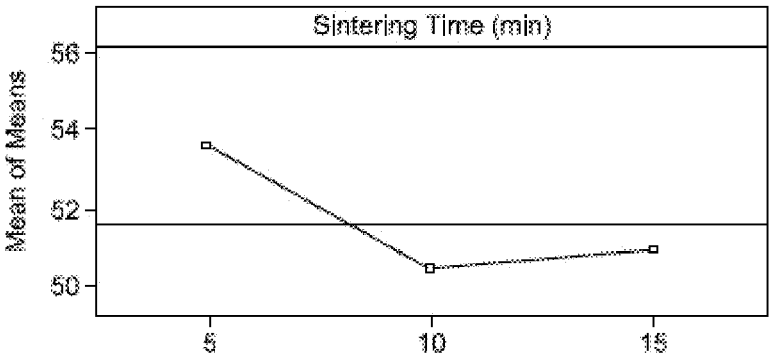
Figure 9A:
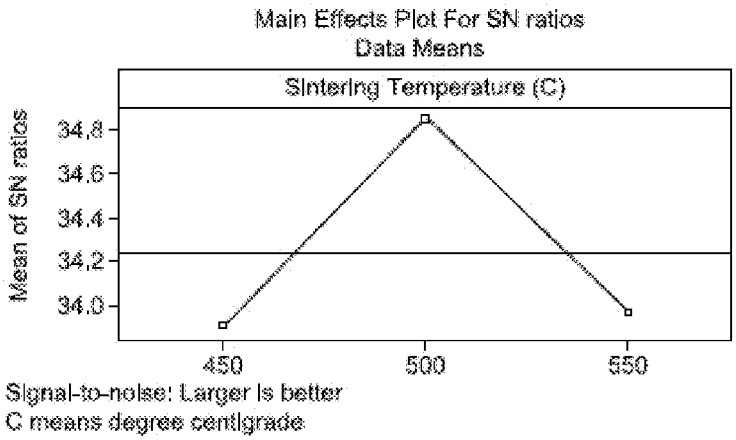
FIG. 9A-9C shows the main effect plots for the S/N ratio for microhardness, where FIG. 9A plots vs. sintering temperature, FIG. 9B plots vs. sintering pressure, and FIG. 9C plots vs sintering time.
Figure 9B:
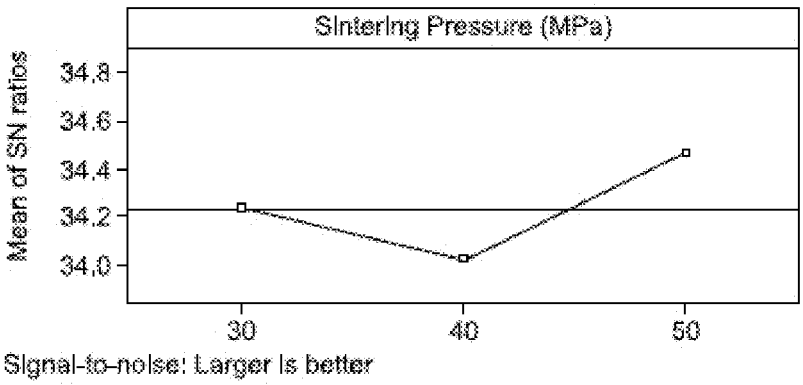
Figure 9C:
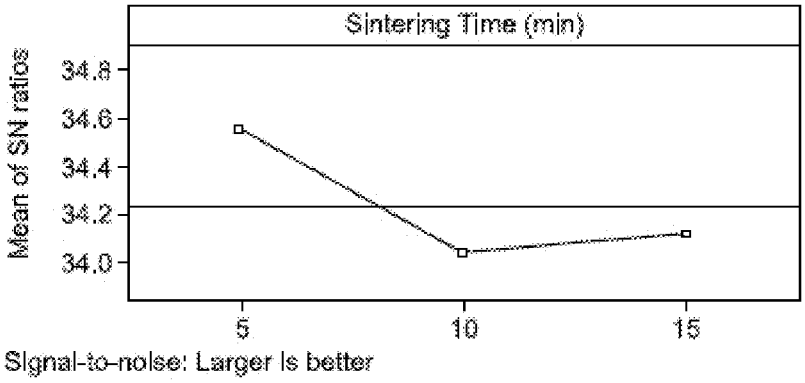

A total of nine experiments are carried out to investigate the influence of uncontrollable parameters in terms of the S/N ratio on the sintering process, where each of the experiments is replicated at least five times. The main effect plots for the mean microhardness and S/N ratio are presented in FIG. 8 and FIG. 9, respectively. These plots depict the average values of each individual experiment and are used to effectively investigate the effect of factors on the mechanical properties. It can be easily inferred from Table 3 that the 500° C. sintering temperature gives the highest microhardness. This result can be attributed to the addition of the $TiB_2$ reinforcement to the Mg matrix. This reinforcement resulted in the refinement of the matrix microstructure and led to a small grain size. The small grain size could be the reason for the high hardness. However, in contrast, at 550° C., the microhardness of the composite seems to be lower. This result could be attributed to grain growth at high temperatures. The effect of sintering pressure can be observed where a high pressure of 50 MPa and more plastic deformation occurred, which led to a smaller grain size and resulted in high microhardness. The influence of sintering time is similar to that of sintering temperature; a high sintering time of 15 min resulted in grain growth and led to lower microhardness.

ANOVA was performed to investigate the relative influence of the process parameters on the microhardness. The ANOVA technique tests the difference between two or more means by variance analysis. This technique was carried out in Minitab 16 software at a 95% confidence interval (significance level $\alpha$=0.05), and the results are presented in Tables 4-7. All tables provide a summary of ANOVA for microhardness and S/N ratio.

In Table 4, all the sintering parameters have a p-value less than 0.05, which indicates that all the parameters have a high influence on the microhardness of the Mg-2.5$TiB_2$ composite. The sintering temperature with a p-value of 0.001 is clearly the most statistically significant sintering parameter, followed by sintering time and sintering pressure, with p-values of 0.005 and 0.007, respectively, exhibiting statistical significance. It could be easily inferred that the measured microhardness was highly affected by all the sintering parameters.

The p-value in ANOVA is used to check the significance of a variable on a process. It may also be used to indicate interaction patterns among variables. A lower p-value indicates a significant influence of a variable on the process. In addition, the F-value and sum of squares can also help identify the most significant factor. Generally, factors with high F-values and sum of squares are the most significant. The ranking of sintering parameters for achieving the best mean microhardness and mean S/N ratio is also shown with ANOVA analysis. The degree of freedom (DoF) represents the number of independent values in the final test statistic calculation. The sequential sum of squares (Seq SS) represents the reduction in the error sum of squares for introducing one or more independent variables to the regression model. Seq SS is used to check whether one or more than two but less than all slope parameters are zero. The adjusted sum of squares (Adj SS) is used to measure the variation in various parts of the model or term and then calculate the p-value. The adjusted mean square (Adj MS) is responsible for measuring the extent of variation in a term or model, and Minitab uses it to measure the p-value.

TABLE 3

Experimental results according to sintering parameters for the mean microhardness and S/N ratio

| Experiment | S. Temp (° C.) | S. Pres (MPa) | S. Time (min) | Mean Microhardness (Hv) | Mean S/N Ratio (dB) |
|---|---|---|---|---|---|
| 1 | 450 | 30 | 5 | 51.4 | 34.2139 |
| 2 | 450 | 40 | 10 | 47.0 | 33.4420 |
| 3 | 450 | 50 | 15 | 50.4 | 34.0486 |
| 4 | 500 | 30 | 10 | 54.2 | 34.6800 |
| 5 | 500 | 40 | 15 | 53.2 | 34.5182 |
| 6 | 500 | 50 | 5 | 58.6 | 35.3580 |
| 7 | 550 | 30 | 15 | 49.0 | 33.8039 |
| 8 | 550 | 40 | 5 | 50.6 | 34.0830 |
| 9 | 550 | 50 | 10 | 50.0 | 33.9794 |

TABLE 4

ANOVA analysis for mean microhardness

| Source | DF | Seq SS | Adj SS | Adj MS | F-Value | P-Value |
|---|---|---|---|---|---|---|
| S. Temp (° C.) | 2 | 62.827 | 62.827 | 31.413 | 785.33 | 0.001 |
| S. Pres (MPa) | 2 | 11.227 | 11.227 | 5.613 | 140.33 | 0.007 |
| S. Time (min) | 2 | 17.147 | 17.147 | 8.573 | 214.33 | 0.005 |
| Error | 2 | 0.080 | 0.080 | 0.040 | | |
| Total | 8 | 91.280 | | | | |

TABLE 5

Ranking response table for microhardness

| Level | S. Temp (° C.) | S. Pres (MPa) | S. Time (min) |
|---|---|---|---|
| 1 | 49.60 | 51.53 | 53.53 |
| 2 | 55.33 | 50.27 | 50.40 |
| 3 | 49.87 | 53.00 | 50.87 |
| Delta | 5.73 | 2.73 | 3.13 |
| Rank | 1 | 3 | 2 |

TABLE 6

ANOVA analysis of the mean S/N ratio

| Source | DF | Seq SS | Adj SS | Adj MS | F-Value | P-Value |
|---|---|---|---|---|---|---|
| S. Temp (° C.) | 2 | 1.70682 | 1.70682 | 0.853410 | 236.60 | 0.004 |
| S. Pres (MPa) | 2 | 0.30053 | 0.30053 | 0.150266 | 41.66 | 0.023 |
| S. Time (min) | 2 | 0.46282 | 0.46282 | 0.231412 | 64.16 | 0.015 |
| Error | 2 | 0.00721 | 0.00721 | 0.003607 | | |
| Total | 8 | 2.47739 | | | | |

TABLE 7

Ranking response table for S/N Ratio

| Level | S. Temp (° C.) | S. Pres (MPa) | S. Time (min) |
|---|---|---|---|
| 1 | 33.90 | 34.23 | 34.55 |
| 2 | 34.85 | 34.01 | 34.03 |
| 3 | 34.96 | 34.46 | 34.12 |
| Delta | 0.95 | 0.45 | 0.52 |
| Rank | 1 | 3 | 2 |

Influence of the Input Parameters on Macrohardness

Figure 10A:
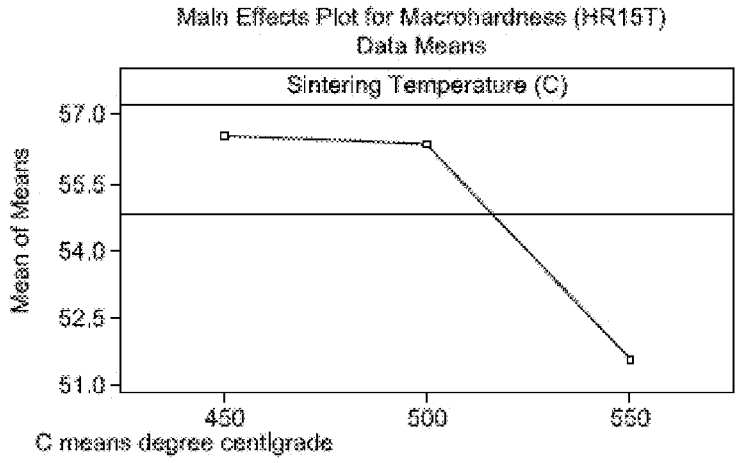
FIGS. 10A-10C shows the main effect plots for macrohardness, where FIG. 10A plots vs. sintering temperature, FIG. 10B plots vs. sintering pressure, and FIG. 10C plots vs sintering time.
Figure 10B:
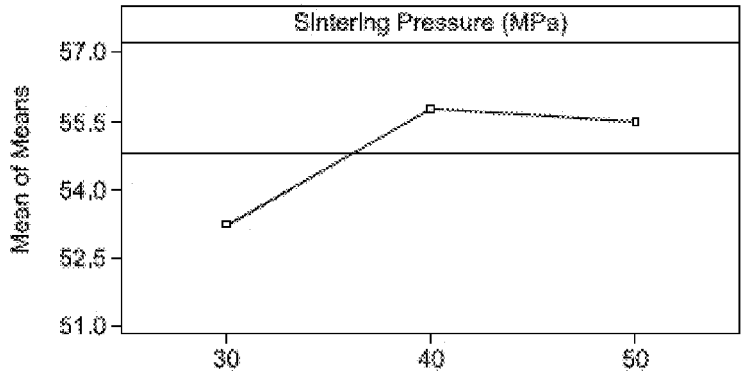
Figure 10C:
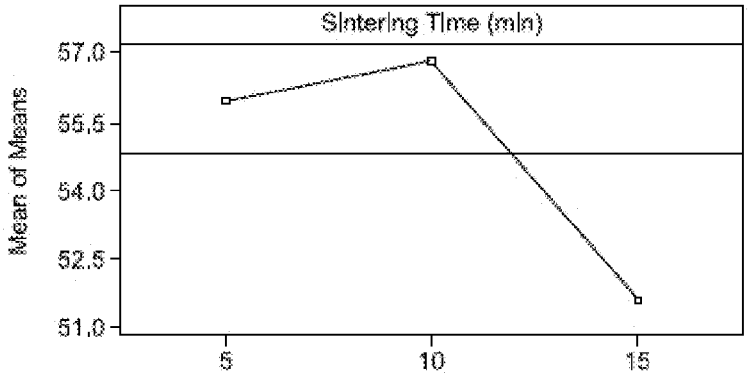
Figure 11A:
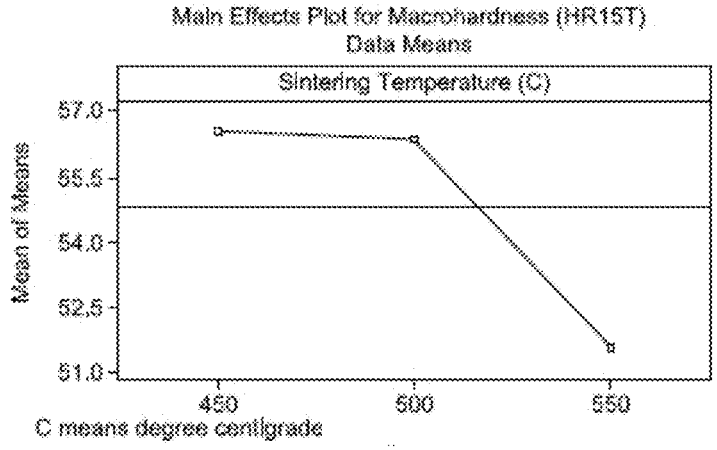
FIG. 11A-11C shows the main effect plots for the S/N ratio for macrohardness, where FIG. 11A plots vs. sintering temperature, FIG. 11B plots vs. sintering pressure, and FIG. 11C plots vs sintering time.
Figure 11B:
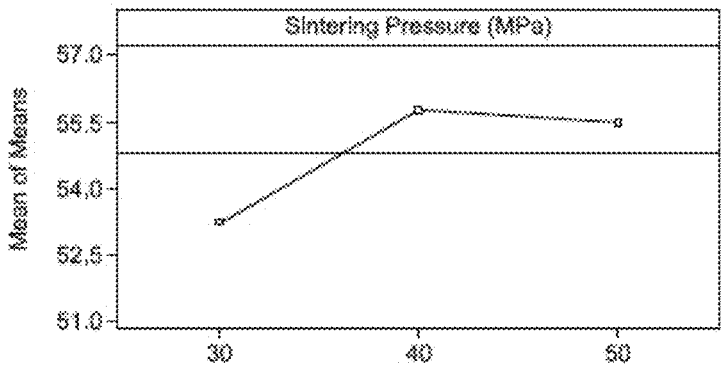
Figure 11C:
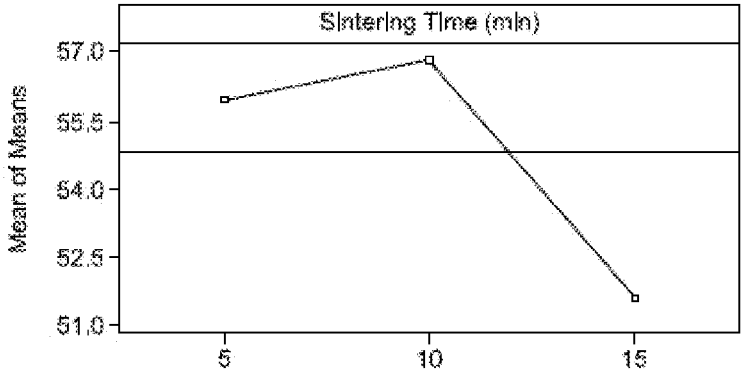

The L9 OA for measured macrohardness from the Rockwell test on a scale of HR15T is represented in Table 8. The main effect plots for the average macrohardness and S/N ratio are also depicted in FIG. 10 and FIG. 11, respectively. It could be observed that there is slight variation in macrohardness between 450° C. and 500° C., and the value decreased significantly with a further increase in sintering temperature, reaching a minimum value of 37.872 HR. This result could be ascribed to the higher grain growth at high temperatures. The Hall-Petch relationship is applicable where the macrohardness decreases with the increase in grain size [Xu, Y., et. al., 2018, Prog. Nat. Sci. Mater. Int., 28(6), 724-730—incorporated herein by reference]. The increase in material temperature enhanced the migration and annihilation of dislocations, which reduced the dislocation density. Thus, the number of grains per grain boundary decreased and resulted in a larger grain size. With an increase in sintering pressure, plastic deformation increases, which leads to higher plastic deformation and a higher number of dislocations and dislocation density. Thus, higher dislocation resulted in smaller grain size, which increased the macrohardness. However, a pressure of more than 40 MPa with a longer sintering time resulted in a larger grain size and, therefore, had the opposite effect. In addition, the influence of sintering time on the macrohardness of Mg—$TiB_2$ is paramount and increases with increasing heating time. The maximum value of 60.248 Hv was obtained at 10 min of sintering time, and a further increase in time resulted in a significant reduction in macrohardness. This result is possibly due to high grain growth, which occurred due to the high exposure time under elevated temperatures.

TABLE 8

Experimental results according to sintering parameters for the mean macrohardness and S/N ratio

| Experiment | S. Temp (° C.) | S. Pres (MPa) | S. Time (min) | Mean Macrohardness (Hv) | Mean S/N Ratio (dB) |
|---|---|---|---|---|---|
| 1 | 450 | 30 | 5 | 62.186 | 35.8739 |
| 2 | 450 | 40 | 10 | 50.626 | 34.0875 |
| 3 | 450 | 50 | 15 | 56.852 | 35.0949 |
| 4 | 500 | 30 | 10 | 59.612 | 35.5067 |
| 5 | 500 | 40 | 15 | 60.184 | 35.5896 |
| 6 | 500 | 50 | 5 | 49.364 | 33.8682 |
| 7 | 550 | 30 | 15 | 37.872 | 31.5664 |
| 8 | 550 | 40 | 5 | 56.518 | 35.0437 |
| 9 | 550 | 50 | 10 | 60.248 | 35.5989 |

TABLE 9

ANOVA analysis for mean macrohardness

| Source | DF | Seq SS | Adj SS | Adj MS | F-Value | P-Value |
|---|---|---|---|---|---|---|
| S. Temp (° C.) | 2 | 48.5 | 48.5 | 24.3 | 0.13 | 0.884 |
| S. Pres (MPa) | 2 | 11.7 | 11.7 | 5.9 | 0.03 | 0.969 |
| S. Time (min) | 2 | 46.9 | 46.9 | 23.4 | 0.13 | 0.888 |
| Error | 2 | 369.9 | 369.9 | 185.0 | | |
| Total | 8 | 477.1 | | | | |

TABLE 10

Ranking response table for macrohardness

| Level | S. Temp (° C.) | S. Pres (MPa) | S. Time (min) |
|---|---|---|---|
| 1 | 56.55 | 53.22 | 56.02 |
| 2 | 56.39 | 55.78 | 56.83 |
| 3 | 51.55 | 55.49 | 51.64 |
| Delta | 5.01 | 2.55 | 5.19 |
| Rank | 2 | 3 | 1 |

TABLE 11

ANOVA analysis for the mean S/N ratio

| Source | DF | Seq SS | Adj SS | Adj MS | F-Value | P-Value |
|---|---|---|---|---|---|---|
| S. Temp (° C.) | 2 | 1.7454 | 1.7454 | 0.8727 | 0.16 | 0.860 |
| S. Pres (MPa) | 2 | 0.6423 | 0.6423 | 0.3211 | 0.06 | 0.943 |
| S. Time (min) | 2 | 1.6942 | 1.6942 | 0.8471 | 0.16 | 0.863 |
| Error | 2 | 10.7065 | 10.7065 | 5.3532 | | |
| Total | 8 | 14.7883 | | | | |

TABLE 12

Ranking response table for the S/N ratio

| Level | S. Temp (° C.) | S. Pres (MPa) | S. Time (min) |
|---|---|---|---|
| 1 | 35.02 | 34.32 | 34.93 |
| 2 | 34.99 | 34.91 | 35.06 |
| 3 | 34.07 | 34.85 | 34.08 |
| Delta | 0.95 | 0.59 | 0.98 |
| Rank | 2 | 3 | 1 |

Influence of the Input Parameters on Density

The L9 orthogonal array based on the Taguchi design for the measured experimental density (ED) from Archimedes' principle is presented in Table 13 along with the S/N ratio. In addition, the theoretical density (TD) of the composite and the standard deviation of density values are also presented in Table 13.

Figure 12A:
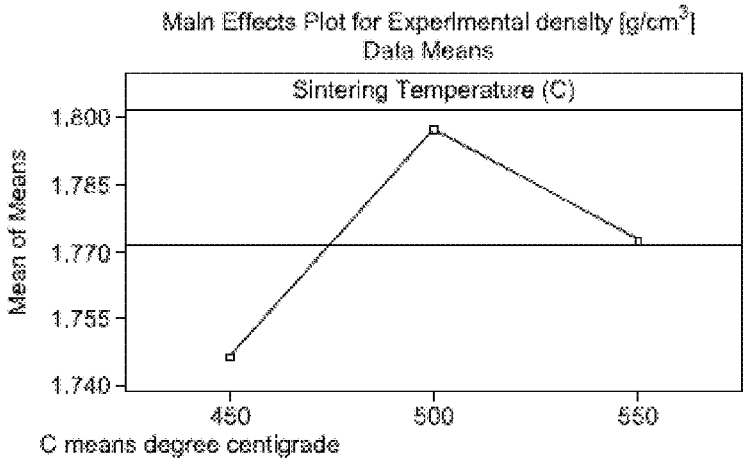
FIG. 12A-12C shows the main effect plots for experimental density, where FIG. 12A plots vs. sintering temperature, FIG. 12B plots vs. sintering pressure, and FIG. 12C plots vs sintering time
Figure 12B:
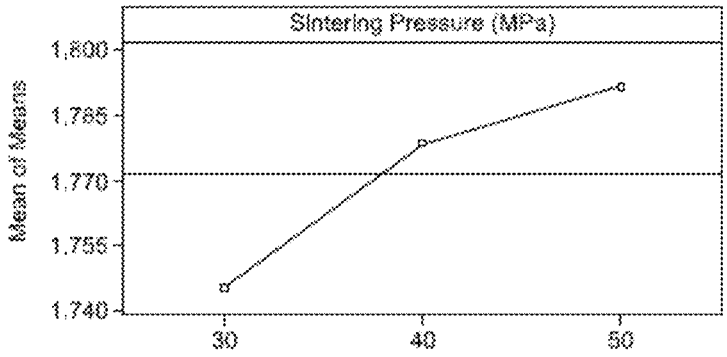
Figure 12C:
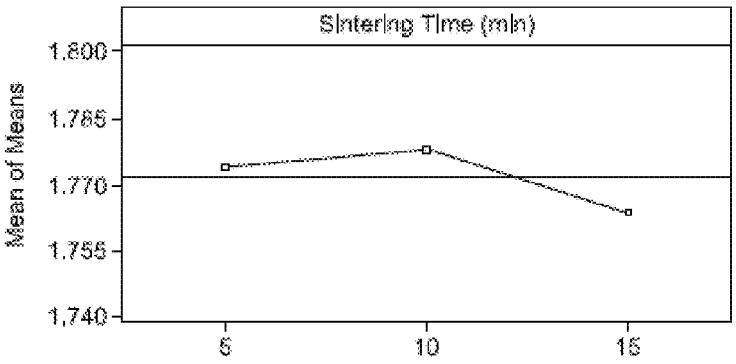
Figure 13A:
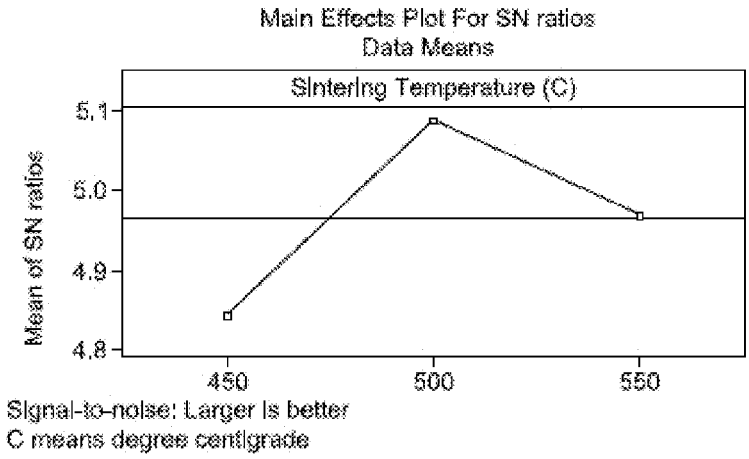
FIG. 13A-13C shows the main effect plots for the S/N ratio for experimental density, where FIG. 13A plots vs. sintering temperature, FIG. 13B plots vs. sintering pressure, and FIG. 13C plots vs sintering time.
Figure 13B:
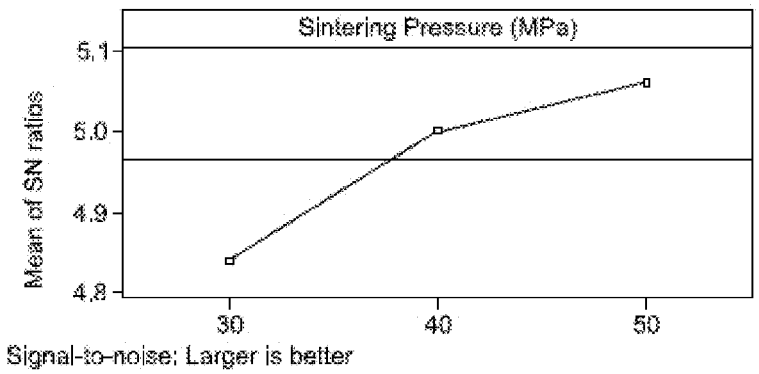
Figure 13C:
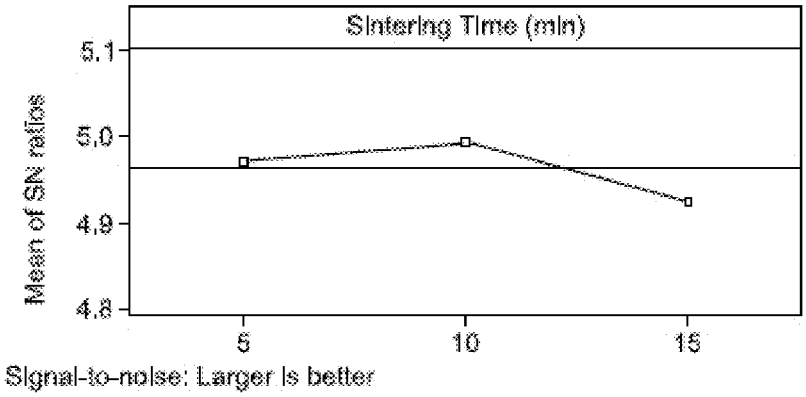

The main effect plots for the average density and S/N ratio are depicted in FIG. 12 and FIG. 13, respectively. It could be observed in FIG. 12 that the density increased with increasing sintering temperature and then subsequently decreased with a further increase in sintering temperature. This typical behavior could be ascribed to the melting and enhanced diffusion of solid particles leading porosity minimization of the Mg-2.5$TiB_2$ composite at 500° C. However, a further increase in sintering temperature to 550° C. increased the volume of the prepared composite and eventually decreased the density. The increased density of the composite could also be attributed to the higher density (4.52 g/cm3) of the $TiB_2$ reinforcement [Meenashisundaram, G. K., et. al., 2014, Mater. Charact., 94, 178-188]. It could be inferred from the higher density that the SPS consolidation process used in this study can be used to fabricate dense materials. The standard deviation in density is very low at 500° C., which reveals the fairly good distribution of the $TiB_2$ reinforcement in the Mg matrix. The minimum porosity of 0.235% could be easily achieved with the specific parameters in Table 13 using the novel SPS technique of consolidation.

TABLE 13

Experimental results according to sintering parameters for the mean density and S/N ratio.

| Experiment | S. Temp (° C.) | S. Pres (MPa) | S. Time (min) | Theoretical Density (g/cm$^3$) | Mean Experimental Density (g/cm$^3$) | Standard Deviation | Porosity (%) | Mean S/N ratio (dB) |
|---|---|---|---|---|---|---|---|---|
| 1 | 450 | 30 | 5 | 1.8076 | 1.72508 | 0.035766 | 4.562801 | 4.73616 |
| 2 | 450 | 40 | 10 | 1.8076 | 1.74313 | 0.002109 | 3.564052 | 4.82659 |
| 3 | 450 | 50 | 15 | 1.8076 | 1.76843 | 0.025827 | 2.164479 | 4.95174 |
| 4 | 500 | 30 | 10 | 1.8076 | 1.78835 | 0.003174 | 1.06234 | 5.04904 |
| 5 | 500 | 40 | 15 | 1.8076 | 1.79943 | 0.000411 | 0.449308 | 5.10269 |
| 6 | 500 | 50 | 5 | 1.8076 | 1.80279 | 0.001625 | 0.253642 | 5.11975 |
| 7 | 550 | 30 | 15 | 1.8076 | 1.72182 | 0.014248 | 4.742841 | 4.71976 |
| 8 | 550 | 40 | 5 | 1.8076 | 1.79270 | 0.000656 | 4.562801 | 5.07016 |
| 9 | 550 | 50 | 10 | 1.8076 | 1.80201 | 0.001819 | 3.564052 | 5.11513 |

It can also be observed from FIG. 12 that the experimental density of the composite increased with increasing sintering pressure. This result could be attributed to the decrease in the volume of the solid composite powder. In addition, an increase in pressure during sintering filled the intergranular pores and led to a higher density. The influence of sintering time on the experimental density of Mg-2.5$TiB_2$ is similar to that of sintering temperature with little abrupt variation. In the beginning, the density was lower due to insufficient diffusion and higher porosity due to interparticle voids. However, at a 10 min sintering time, the diffusion was sufficient to fill the existing pores and increase the experimental density without any variation or with minimal variation in volume. However, a further increase in sintering time to 15 min exposed the composite material to a high temperature for a longer time. This led to a higher volume of the composite, and eventually, the density was reduced. The results obtained from the ANOVA test for the experimental density, S/N ratio and factor ranking are depicted in Tables 14-17. By examining the p-value for all the process parameters and the S/N ratio, it can be inferred that none of the factors significantly contribute to the variation in the experimental density of the Mg-2.5$TiB_2$ microcomposite, because the p-value for each factor is greater than the confidence interval of 5%. All the factors of sintering temperature, sintering pressure and sintering time were negligible. However, the sintering pressure and sintering time are dominant among the least negligible factors affecting the variation in experimental density. The sintering temperature with a p-value of 0.229 is the post passive of the least negligible factors influencing the composite experimental density.

TABLE 14

ANOVA analysis for the mean experimental density

| Source | DF | Seq SS | Adj SS | Adj MS | F-Value | P-Value |
|---|---|---|---|---|---|---|
| S. Temp (° C.) | 2 | 0.0039602 | 0.0039602 | 0.0019801 | 3.36 | 0.229 |
| S. Pres (MPa) | 2 | 0.0033938 | 0.0033938 | 0.0016969 | 2.88 | 0.258 |
| S. Time (min) | 2 | 0.0003385 | 0.0003385 | 0.0001692 | 0.29 | 0.777 |
| Error | 2 | 0.0011792 | 0.0011792 | 0.0005896 | | |
| Total | 8 | 0.0088718 | | | | |

TABLE 15

Ranking response table for experimental density

| Level | S. Temp (° C.) | S. Pres (MPa) | S. Time (min) |
|---|---|---|---|
| 1 | 1.746 | 1.745 | 1.774 |
| 2 | 1.797 | 1.778 | 1.778 |

TABLE 15-continued

Ranking response table for experimental density

| Level | S. Temp (° C.) | S. Pres (MPa) | S. Time (min) |
|---|---|---|---|
| 3 | 1.772 | 1.791 | 1.763 |
| Delta | 0.051 | 0.046 | 0.015 |
| Rank | 1 | 2 | 3 |

TABLE 16

ANOVA analysis for the mean S/N ratio

| Source | DF | Seq SS | Adj SS | Adj MS | F-Value | P-Value |
|---|---|---|---|---|---|---|
| S. Temp (° C.) | 2 | 0.09554 | 0.09554 | 0.04777 | 3.30 | 0.232 |
| S. Pres (MPa) | 2 | 0.08269 | 0.08269 | 0.04134 | 2.86 | 0.259 |
| S. Time (min) | 2 | 0.00824 | 0.00824 | 0.00412 | 0.28 | 0.778 |
| Error | 2 | 0.02894 | 0.02894 | 0.01447 | | |
| Total | 8 | 0.21541 | | | | |

TABLE 17

Ranking response table for the S/N ratio

| Level | S. Temp (° C.) | S. Pres (MPa) | S. Time (min) |
|---|---|---|---|
| 1 | 4.838 | 4.835 | 4.975 |
| 2 | 5.090 | 5.000 | 4.997 |
| 3 | 5.968 | 5.062 | 4.925 |
| Delta | 0.252 | 0.227 | 0.072 |
| Rank | 1 | 2 | 3 |

Obviously, numerous modifications and variations of the present invention are possible in light of the above teachings. It is therefore to be understood that, within the scope of the appended claims, the invention may be practiced otherwise than as specifically described herein.

The invention claimed is:

1. A method of making a biodegradable magnesium metal composite, the method comprising:

milling a solid mixture of magnesium powder and $TiB_2$ powder to form a milled powder; and spark plasma sintering the milled powder to form the biodegradable magnesium metal composite, wherein the biodegradable magnesium metal composite comprises a polycrystalline magnesium matrix and 0.5 to 5.0 wt. % $TiB_2$ grains which are homogenously distributed in the polycrystalline magnesium matrix, at least 99 wt. % of the total weight of the biodegradable magnesium metal composite is the polycrystalline magnesium matrix and the $TiB_2$ grains, wherein the $TiB_2$ grains have a mean grain size of 20 to 50 μm and the polycrystalline magnesium matrix is in the form of a polycrystalline matrix of magnesium grains having a mean grain size of 20 to 50 μm, wherein the biodegradable magnesium metal composite has a microhardness in a range of from 40 to 65 HV, and a macrohardness in a range of from 36 to 65 HV.

2. The method of claim 1, wherein the milling is performed in a steel vial at a rotational rate in a range of from 50 to 500 rpm for a time in a range of from 1 to 120 minutes without milling balls, and wherein the milling is performed in an inert atmosphere.

3. The method of claim 1, wherein $TiB_2$ is present in the biodegradable magnesium metal composite in an amount in a range of from 1.25 to 3.5 wt. %, based on a total weight of the biodegradable magnesium metal composite.

4. The method of claim 1, wherein the biodegradable magnesium metal composite consists of crystalline Mg and crystalline $TiB_2$ phases and has no other crystalline phases present detectable by X-Ray diffraction or electron microscopy.

5. The method of claim 1, wherein the polycrystalline magnesium matrix has a basal texture.

6. The method of claim 1, wherein the spark plasma sintering is performed at a pressure in a range of from 20 to 60 MPa.

7. The method of claim 1, wherein the spark plasma sintering is performed at a temperature in a range of from 400 to 600° C.

8. The method of claim 1, wherein the spark plasma sintering is performed for a time in a range of from 1 to 20 minutes.

9. The method of claim 1, wherein a rate of heating during the spark plasma sintering is in a range of from 40 to 200° C./min.

10. The method of claim 1, wherein the biodegradable magnesium metal composite has a microhardness in a range of from 41 to 64 HV.

11. The method of claim 1, wherein the biodegradable magnesium metal composite has a macrohardness in a range of from 38 to 64 HV.

12. The method of claim 1, wherein the biodegradable magnesium metal composite has a density in a range of from 1.720 to 1.810 g/cm$^3$.

13. The method of claim 1, wherein the biodegradable magnesium metal composite has a porosity in a range of from 0.1 to 5%.

14. The method of claim 1, wherein the biodegradable magnesium metal composite has a microhardness in a range of from 47 to 59 HV, a macrohardness in a range of from 57 to 62.5 HV, a density in a range of from 1.78 to 1.8076 g/cm$^3$, and a porosity in a range of from 0.25 to 4%.

15. The method of claim 1, wherein the $TiB_2$ is present in the biodegradable magnesium metal composite in an amount in a range of from 2 to 3 wt. %, based on a total weight of the biodegradable magnesium metal composite.

16. The method of claim 1, wherein the $TiB_2$ is present in the biodegradable magnesium metal composite in an amount in a range of from 2.25 to 2.75 wt. %, based on a total weight of the biodegradable magnesium metal composite.

17. The method of claim 1, wherein at least 99.5 wt. % of the total weight of the biodegradable magnesium metal composite is the polycrystalline magnesium matrix and the $TiB_2$ grains.

18. The method of claim 1, wherein at least 99.9 wt. % of the total weight of the biodegradable magnesium metal composite is the polycrystalline magnesium matrix and the $TiB_2$ grains.

19. The method of claim 1, wherein the biodegradable magnesium metal composite consists of crystalline Mg and crystalline $TiB_2$ phases.

20. The method of claim 1, wherein the biodegradable magnesium metal composite has a microhardness in a range of from 47 to 59 HV, a macrohardness in a range of from 57 to 62.5 HV, a density in a range of from 1.78 to 1.8076 g/cm$^3$, a porosity in a range of from 0.25 to 4%, and wherein the $TiB_2$ is present in the biodegradable magnesium metal composite in an amount of 2.5 wt. %, based on a total weight of the biodegradable magnesium metal composite.

* * * * *